US008833710B1

(12) United States Patent
Atkinson

(10) Patent No.: US 8,833,710 B1
(45) Date of Patent: Sep. 16, 2014

(54) GARBAGE CAN RETAINING DEVICE AND METHOD OF USE

(76) Inventor: David L. Atkinson, Gaines, MI (US)

( * ) Notice: Subject to any disclaimer, the term of this patent is extended or adjusted under 35 U.S.C. 154(b) by 583 days.

(21) Appl. No.: 12/928,846

(22) Filed: Dec. 21, 2010

Related U.S. Application Data

(60) Provisional application No. 61/284,615, filed on Dec. 22, 2009.

(51) Int. Cl.
*A45F 3/44* (2006.01)

(52) U.S. Cl.
USPC ..... 248/156; 248/907; 248/146

(58) Field of Classification Search
USPC ..... 248/907, 519, 520, 523, 500, 507, 508, 248/509, 511, 534, 539, 95, 97, 154, 158, 248/188.8, 188.91, 99, 146
See application file for complete search history.

(56) References Cited

U.S. PATENT DOCUMENTS

| | | | | |
|---|---|---|---|---|
| 3,638,802 | A * | 2/1972 | Westerfield | 211/85.19 |
| 4,193,233 | A * | 3/1980 | VandenHoek et al. | 52/126.4 |
| 4,559,747 | A * | 12/1985 | Engel | 52/40 |
| 5,887,834 | A * | 3/1999 | Gellos et al. | 248/156 |
| 6,409,129 | B1 * | 6/2002 | Chen et al. | 248/188.8 |
| 7,654,407 | B1 * | 2/2010 | Obrecht et al. | 220/475 |

* cited by examiner

*Primary Examiner* — Steven Marsh
(74) *Attorney, Agent, or Firm* — L. C. Begin & Associates, PLLC

(57) ABSTRACT

A garbage can retaining device adapted to retain garbage cans and to mount to any substantially planar surface such as natural ground or man-made materials. The device including includes: a mount member adapted to mount the garbage can retaining device to any substantially planar surface, wherein the mount member is adapted to receive a shaft and base assembly within an interior region and to fixedly secure the shaft and base assembly to the mount member, the shaft and base assembly including a shaft having a plurality of attachments attached thereto; a garbage can contacting portion secured to the shaft; and a base securely formed with the shaft adapted to be slidably received within the interior region of the mounting member.

4 Claims, 32 Drawing Sheets

GARBAGE CAN RETAINING DEVICE AND METHOD OF USE

CROSS-REFERENCE TO RELATED APPLICATIONS

This is a non-provisional utility patent application that claims the benefit of priority from U.S. Provisional Patent Application Ser. No. 61/284,615, entitled "Garbage Can Retaining Device and Method of Use" filed Dec. 22, 2009, the disclosure of which is hereby incorporated herein by reference in its entirety.

BACKGROUND

When garbage cans are full near a curb awaiting pickup, there is a possibility that the can may tip over or blow away. This problem becomes more prevalent once the garbage has been emptied on garbage day. What is needed is a garbage can retaining device that retains both full or empty cans thereby protecting against the messy spilling or the loss of garbage cans not otherwise secured in a fixed position relative to a ground surface.

SUMMARY OF THE INVENTION

In general, the garbage can retaining device includes: a mount member adapted to mount the garbage can retaining device to any substantially planar surface, wherein the mount member is adapted to receive a shaft and base assembly within an interior region and to fixedly secure the shaft and base assembly to the mount member, the shaft and base assembly including a shaft having a plurality of attachments attached thereto; a garbage can contacting portion secured to the shaft; and a base securely formed with the shaft adapted to be slidably received within the interior region of the mounting member.

DETAILED DESCRIPTION OF THE INVENTION

Figure 1:
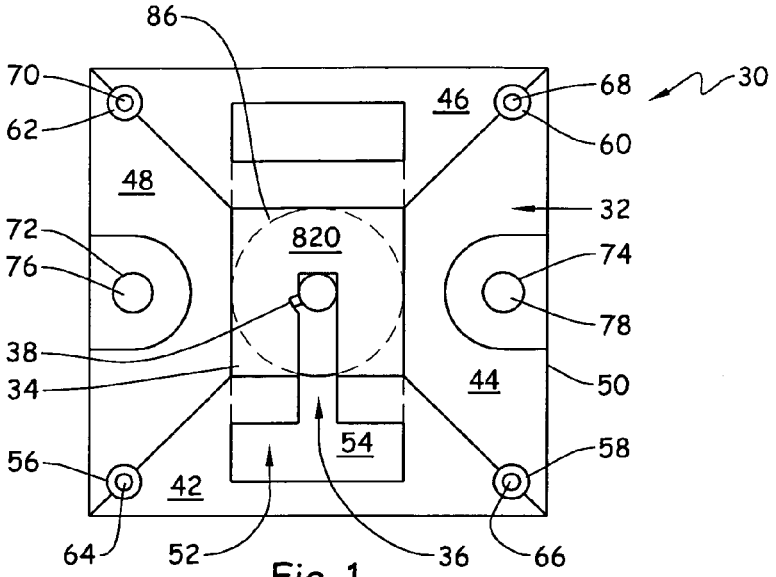
FIG. 1 illustrates a top plan view of a mount having a shaft and base assembly including a shaft, a shaft base, and a locking tab and shaft base retained therein in accordance with an embodiment of the invention.

Generally provided is a Garbage Can Retaining Device and Method of Use that operates as a retaining device for a garbage can or other refuse or waste containers that are typically used to contain items such as waste or recycle materials therein. The garbage can retaining device helps protect against the messy spilling or the loss of garbage cans not otherwise secured in a fixed position relative to a ground surface and further operates as a garbage can storage device when not being used. The garbage can retaining device provides a convenient accessory to a house, condo or apartment by protecting from the time consuming cleanup from a spilled garbage can and or looking for a lost garbage retaining device, as well as, giving a more aesthetic appeal to a house with the convenient storage of the retainer.

The device is convenient, easy to use, compact, and multifunctional, as well as, protects the aesthetic appearance of a person's yard.

The device may be made using any rigid and rustproof material that has come or may come into existence, such as, but not limited to a plastic material or metal alloy, such as aluminum or steel.

In general, the garbage can retaining device includes: a mount member adapted to mount the garbage can retaining device to any substantially planar surface, wherein the mount member is adapted to receive a shaft and base assembly within an interior region and to fixedly secure the shaft and base assembly to the mount member, the shaft and base assembly including a shaft having a plurality of attachments attached thereto; a garbage can contacting portion secured to the shaft; and a base securely formed with the shaft adapted to be slidably received within the interior region of the mounting member.

The mount member is adapted to mount the garbage can retaining device to any substantially planar surface and may be used for multiple applications such as various ground surfaces such as, but not limited to a natural earth or a grass covered lawn or a manmade surface such as concrete or asphalt, typically used to form driveways.

The shaft has a lower portion that may be either integrally formed with the base, or removably secured to the base. Additionally a locking tab may be integrally formed with both the lower portion of the shaft and the base or may be integrally formed with either the base or the shaft for engaging the shaft and base assembly with the mounting member.

Like elements will be referred to with like reference numbers throughout this document.

Referring now to the drawings:

FIG. 1 illustrates a top plan view of the mount member 30 having a shaft and base assembly retained therein in accordance with an embodiment of the invention.

Figure 2:
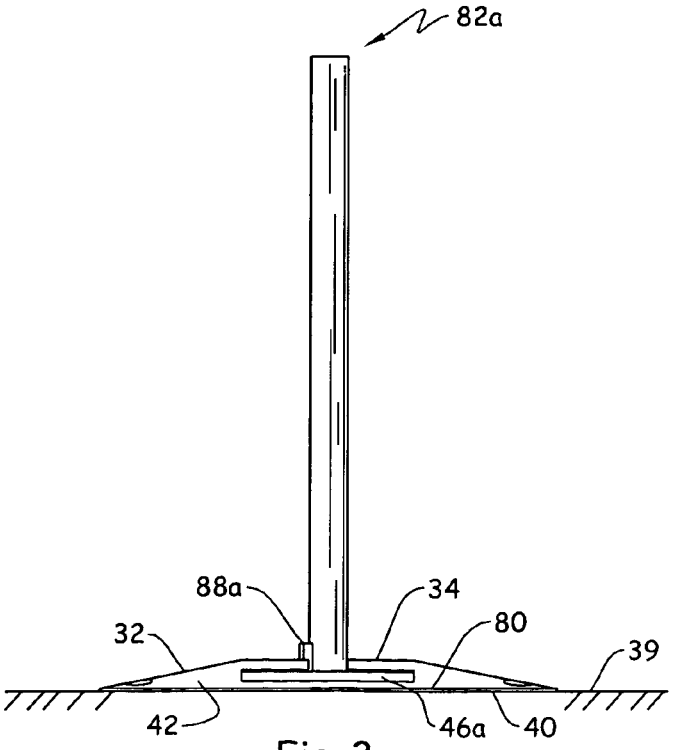
FIG. 2 illustrates a side elevational view of the mount member shown in FIG. 1 mounted on a planar surface.

FIG. 2 illustrates a side elevational view of the mount member 30 mounted on a planar surface 39 including a shaft and base assembly 82*a*.

Figure 3:
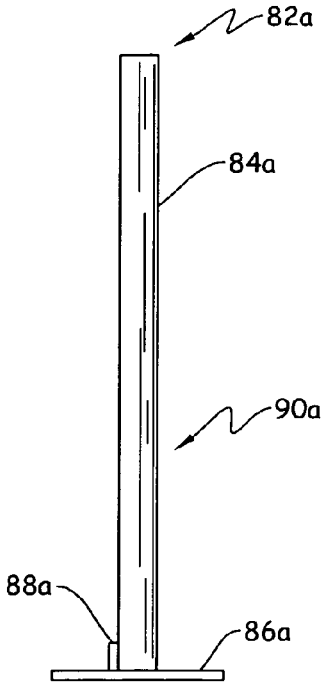
FIG. 3 illustrates a side elevational view of a lower portion of a shaft and locking tab adapted to mate with the complementarily shaped locking tab slot formed within the top cover portion.

FIG. 3 illustrates a side elevational view of a lower portion 90*a* of a shaft and base assembly 82*a* including a shaft 84*a*, a shaft base 86*a*, and a locking tab 88*a* adapted to mate with the complementarily shaped locking tab slot 38 formed within the top cover portion 32 of the mount member 30 as shown in FIGS. 1-2, in accordance with an embodiment of the invention.

As shown in FIGS. 1-3, and FIGS. 8, 11, 13, 16-19, the mount member 30 has a square profile, however, any geometry that includes a bottom planar portion 40 and mounting means that can fixedly secure the garbage retaining device to a ground surface, and that can also fixedly secure a base and shaft portion may be suitable to form the mounting member.

In an embodiment of the invention, shown in FIGS. 1-2, mount member 30 has a top cover portion 32 including a top portion planar surface 34 having a top groove 36 formed therein to slidably receive the shaft 84*a* therethrough, the top groove 36 having a locking tab slot 38 angled outwardly therefrom adapted to receive a locking tab 88*a* integrally formed with the shaft 84*a*, and extending downwardly from the top planar surface 34 are angled portions 42, 44, 46, 48 that extending downwardly to the bottom planar portion 40 form a peripheral edge 50 of the planar bottom portion 40 that is adapted to contact a planar surface 39. The angled portion 42 is aligned with the top groove 36 to form a t-shaped groove 52 within the top cover portion 32, when viewed from a top plan view, as shown in FIG. 1, that is adapted to receive a base 86*a* of the shaft 84*a* therethrough. An open interior region 54 between the top cover portion 32 and the bottom planar portion 40 is formed to allow movement of a base and shaft combination 82*a* between the t-shaped groove 52 within the top cover portion 32 when the shaft 84*a* first contacts the mounting member 30 and the locking tab slot 38 formed with the top groove 36 that receives a locking tab 88*a* associated with the shaft 84*a* to securely retain the shaft 84*a* within the interior region 54. The interior region 54 has a dimension that is at least as large as the maximum width or circumference of the base 86*a* associated with the shaft 84*a* to allow movement of the shaft 84*a* therethrough.

In one embodiment of the invention, the mount member 30 includes a plurality of first surface mounting apertures 56, 58, 60, 62 that are adapted to receive a fastener 64, 66, 68, 70 to either removably or permanently secure the mount member to the ground surface. A plurality of fasteners 64, 66, 68, 70 as such bolts or screws may be used to secure each first surface mounting hole to the ground surface 39. When the ground surface 39 is a hard surface such as cement or asphalt, cement screws may be disposed through the first mounting apertures to secure the mount member 30 to the ground surface 39. Additionally, grout may be applied to the edges of the bottom planar side of the mount member to reinforce and secure the mount member to the ground surface 39.

In one embodiment of the invention, the mount member 30 includes a plurality of second surface mounting apertures 72, 74 that are adapted to receive a fastener 76, 78 to secure the mount member 30 to the ground surface 39. If the ground surface 39 is not a hard surface like cement or asphalt, then a second set of fasteners 76, 78 such as ½"×8" Lag bolts may be used to fixedly secure the mount member to the ground in a stationary position.

The bottom planar portion 40 has an upper surface 80 that provides a floor to support the base 86*a* thereon.

Figure 17:
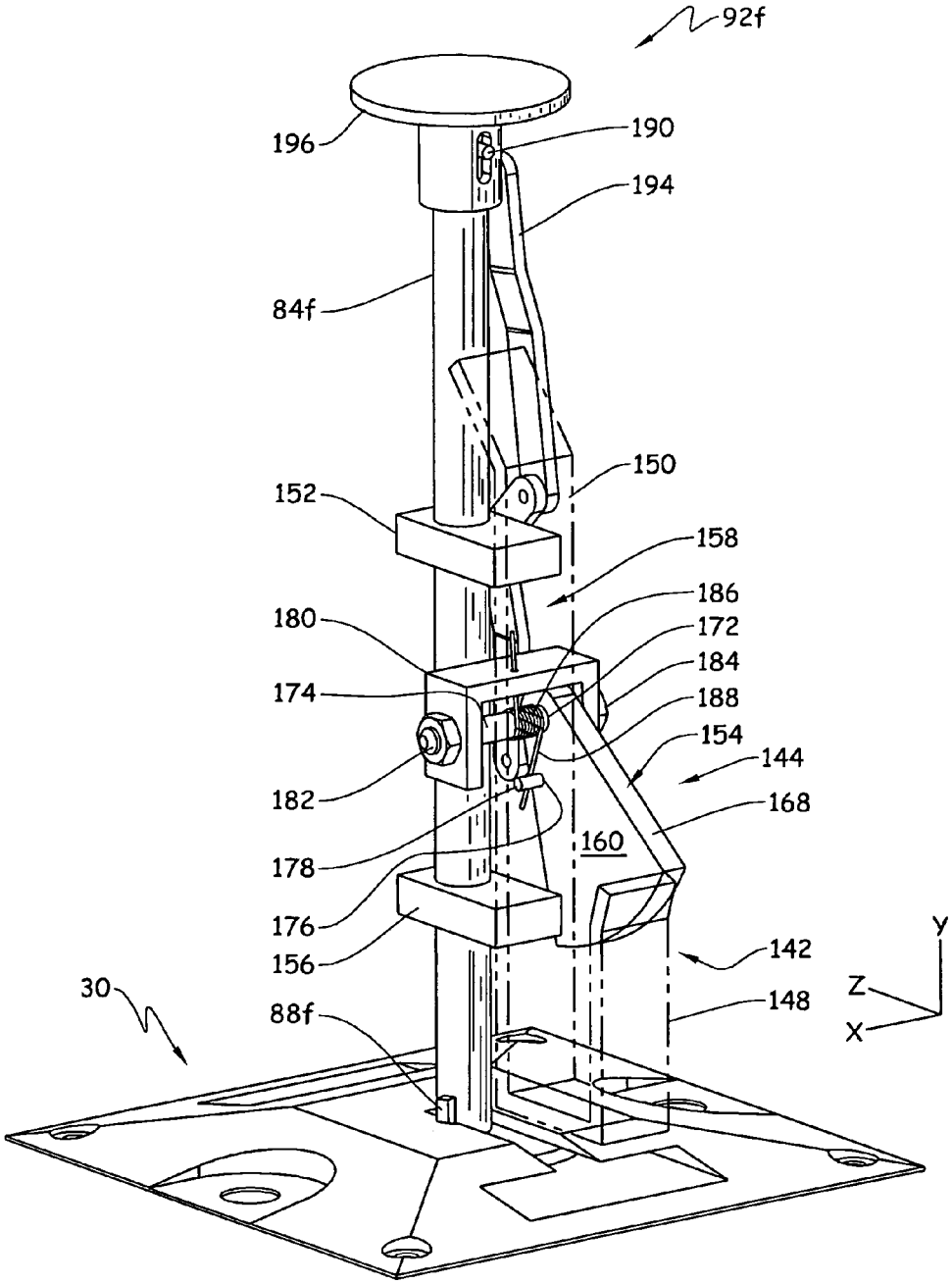
FIG. 17 illustrates a perspective view of a garbage can retaining device with the hook member shown in phantom to further show the details of the pivot assembly in accordance with an embodiment of the invention.
Figure 18:
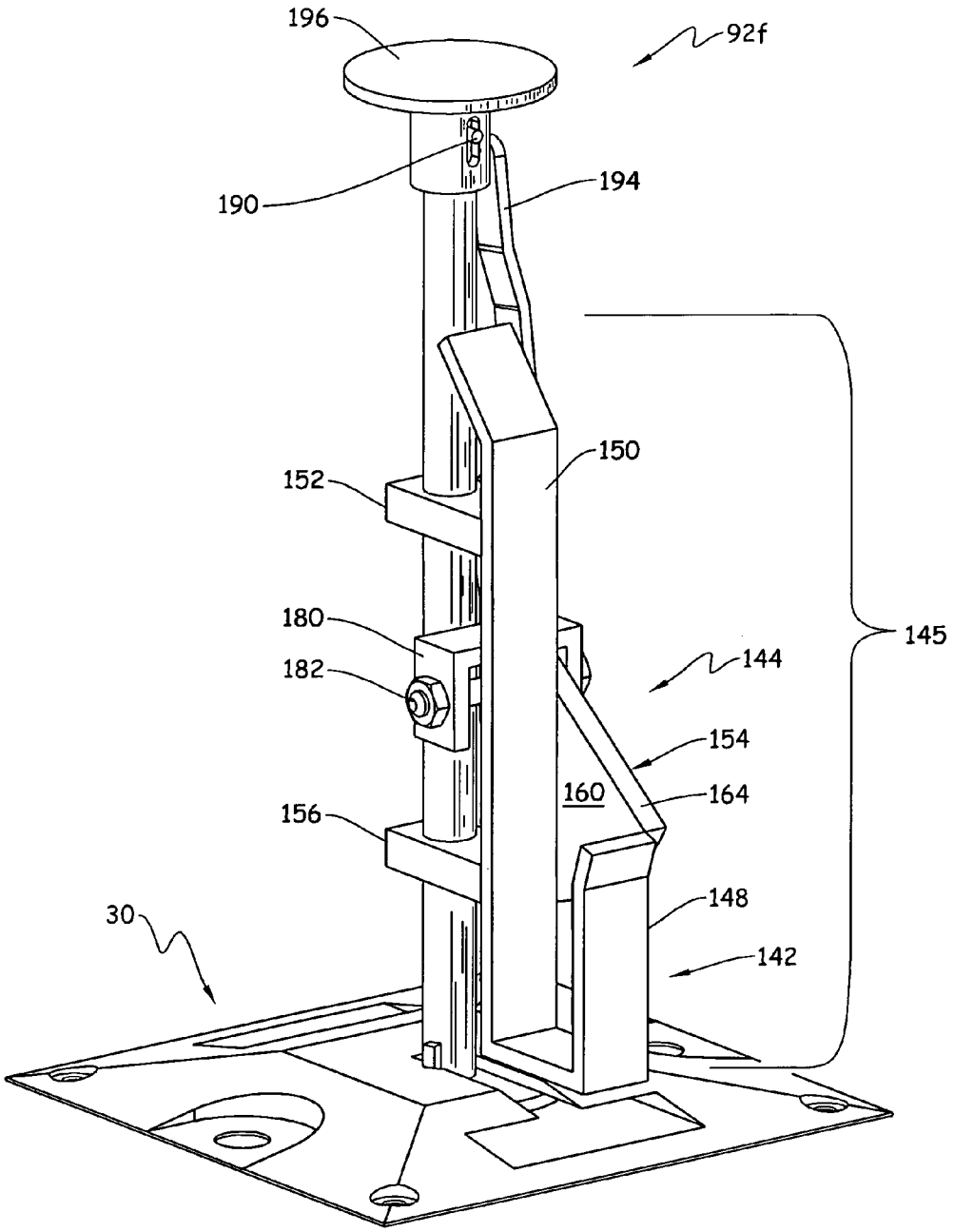
FIG. 18 illustrates a perspective view of the garbage can retaining device including the hook member as a solid.

The base 86, shown in FIG. 1 (as a hidden line) and FIGS. 17-18 as a circular geometry, however, any symmetrical geometry that includes a lower planar portion that contacts the floor of the mounting member may be used.

To fixedly secure the shaft and base assembly within the mounting member 30, the shaft is vertically aligned adjacent to the top cover groove in the mounting member such that the locking tab 88*a* integrally formed with the shaft and base assembly faces away from the interior region 54 of the mounting member 30 and the base is then slidably received along the floor 80 of the mounting member 30 until the shaft contacts an end portion of the groove 36. The shaft is then rotated until the locking tab 88*a* integrally formed with the base and bottom portion of the shaft is received within the locking, tab slot 38 of the top cover 32 of the mounting member 30. The steps for insertion of the shaft and base assembly within the mounting member are reversed to remove the shaft and base assembly from the mounting member.

Figure 4:
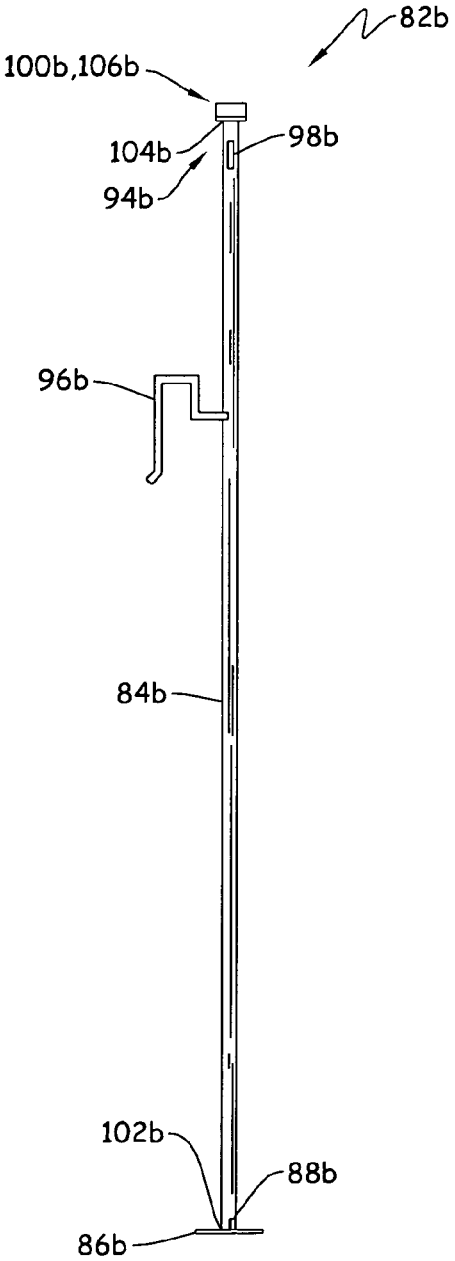
FIG. 4 illustrates a side elevational view of a shaft and base assembly showing a side elevational view of garbage can retaining hook integrally formed with the shaft and a front plan view of a loop member adapted to retain a plurality of removable attachments therethrough in accordance with an embodiment of the invention.
Figure 5:
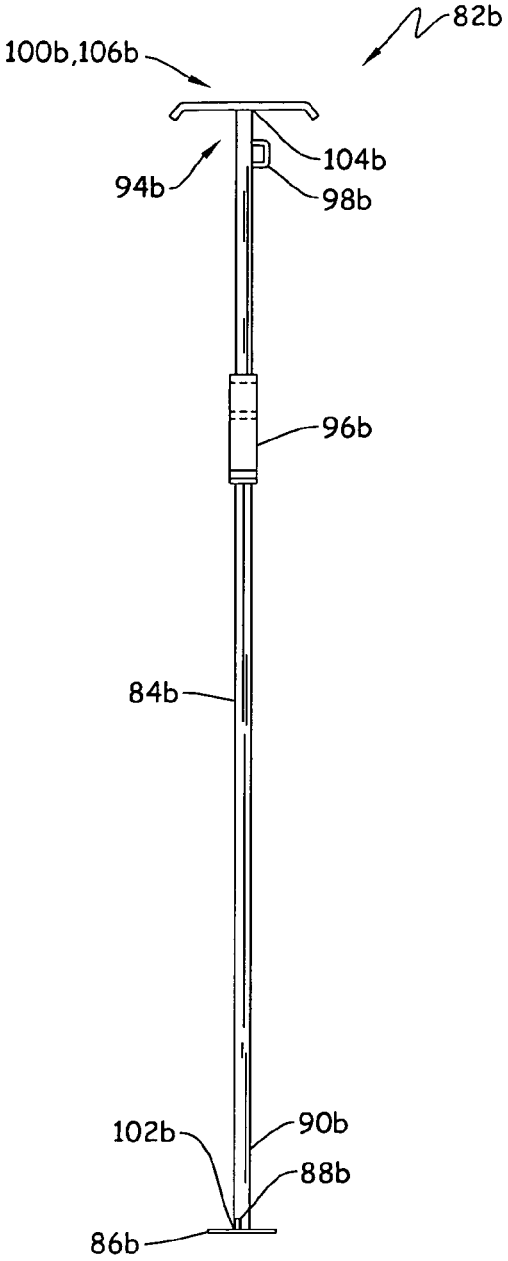
FIG. 5 illustrates a side elevational view of the shaft and base assembly shown in FIG. 4 showing a front plan view of the garbage can retaining hook integrally formed with the shaft and a side elevational view of the loop member in accordance with an embodiment of the invention.

In an embodiment of the invention, a shaft and base assembly 82*b* including a shaft 84*b*, a base 86*b*, and a locking tab 88*b* is shown in FIGS. 4-5, wherein the shaft 84*b* has a lower portion 90*b* either removably or integrally formed with the base 86*b* and an upper portion 94*b* adapted to receive an emptied garbage can. The locking tab 88*b* may be integrally formed with both the lower portion 90*b* of the shaft 84*b* and the base 86*b* or may be integrally formed with either the base 86*b* or the shaft 84*b* for engaging the shaft and base assembly 82*b* with the mounting member 30 (shown in FIGS. 1-3). FIG. 4 illustrates a side elevational view of the shaft and base assembly 82*b* showing a side elevational view of garbage can retaining hook 96*b* integrally formed with the shaft 84*b* and a front plan view of a loop member 98*b* adapted to retain a plurality of removable attachments therethrough. FIG. 5 illustrates a side elevational view of the shaft and base assembly 82*b* showing a front plan view of the garbage can retaining hook 96*b* integrally formed with the shaft 84*b* and a side elevational view of the loop member 98*b*.

As shown in FIGS. 4-5, a shaft 84*b* has a plurality of attachments attached thereto including a garbage can contacting portion 100*b* secured to the shaft 84*b*, the garbage can retaining hook 96*b*, and the loop member 98*b*.

As shown in FIGS. 4-5, the shaft 84*b* has a first lower end 102*b* securely attached to the base 86*b* and the upper portion 94*b* adapted to receive an emptied garbage can via the garbage can contacting portion 100*b*. The garbage can contacting portion 100*b* is formed at a second (upper) end 104*b* of the shaft upper portion 94*b* and defines a T-shaped flange 106*b* adapted to receive a bottom interior portion of an upside-down empty garbage can, wherein the T-shaped flange 106*b* is provided to prevent the shaft second end 104*b* from puncturing the bottom of the garbage can. Additionally the loop member 98*b* may be integrally formed near the second end 94*b* of the shaft 84*b* to receive a clasping member 108, wherein the clasping member 108 may secure a chain 110 having a vice grip 112 at the end of the chain 110 adapted to securely removably engage a handle portion of a garbage can (not shown in FIGS. 4-5, see FIGS. 8-15 for an example of a clasping member). The clasping member 108 acts as an anchoring device and may include a chain or a tether attached to and a fastener or vice grip to securely attach to and prevent a handle or a lid of a garbage can from blowing away or spilling.

In the of the invention shown in FIGS. 4-5, the garbage can retaining hook 96*b* may be integrally formed with the upper portion 94*b* of the shaft 84*b* adapted to store the device with a garbage can.

The lower shaft end 102*b* may be either removably attached to the base 86*b* by non-permanent attaching means such as threadable fasteners or by permanent attaching means such as welding.

Figure 6:
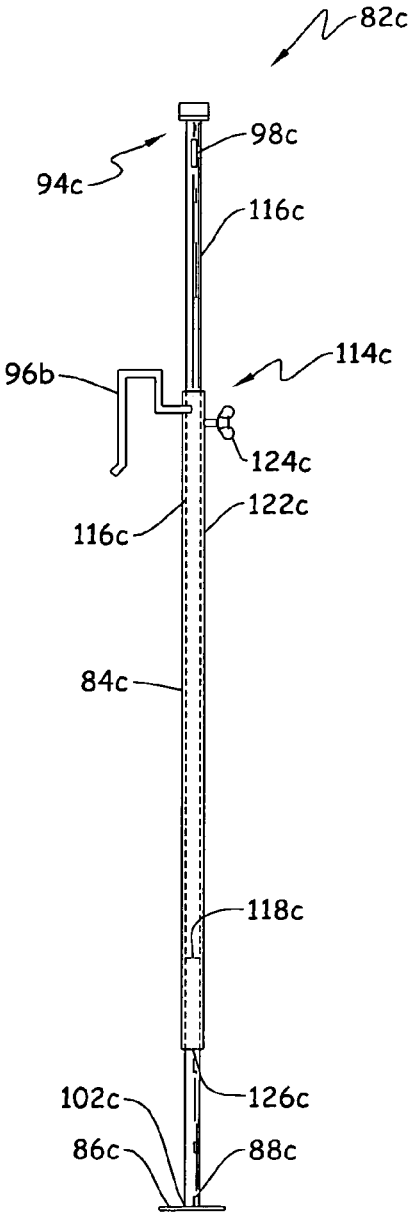
FIGS. 6-7 illustrate an adjustable shaft and base assembly that is adjustable in height to accommodate garbage cans of varying heights in accordance with an embodiment of the invention.
Figure 7:
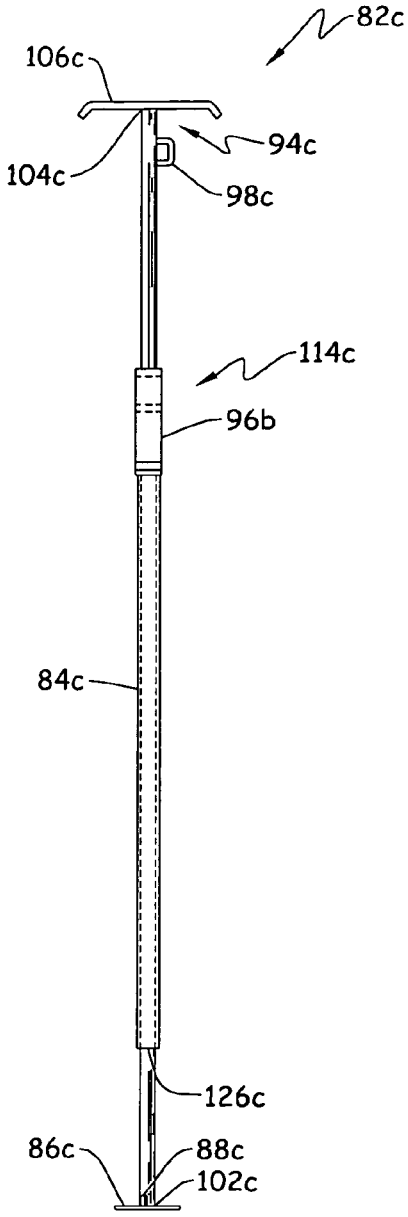

In an embodiment of the invention shown in FIGS. 6-7, the shaft and base assembly 82*c* may be adjustable in height to accommodate garbage cans of varying heights and includes an adjustable shaft assembly 114*c*.

In an embodiment of the invention shown in FIGS. 6-7, the adjustable shaft assembly has a first fixed outer shaft 84*c* similar to the shaft 84*b* described with respect to FIGS. 4-5, and a second inner shaft 116*c* that is slidably received within the first fixed outer shaft 84*c* in telescoping engagement between a first minimum height and a second maximum height. The slidable inner shaft 116*c* has a bottom end 118*c* adapted to engage a portion of the outer shaft and an upper portion 94*c* with a flange 106*c* similar the upper portion 84*b* and flange 106*b* described with respect to FIGS. 4-5.

In an embodiment of the invention illustrated in FIGS. 6-7, the first fixed outer shaft 84*c* has a hollow portion adapted to received the slidable inner shaft 116*c* therein with at least one hole 120*c* disposed through an outer peripheral edge 122*c* of the fixed outer shaft 84*c* adapted to receive a set screw 124*c* such as a wing nut or an anchoring pin therethrough and an interior bottom end 126*c* adapted to engage and support a bottom end of the slidable inner shaft 116*c* when the adjustable shaft assembly is adjusted at the first minimum height. The slidable inner shaft 116*c* may be adjusted to allow the shaft assembly 82*c* to reach the maximum height when the bottom end 118*c* of the slidable inner shaft 116*c* is aligned with the at least one hole 120*c* disposed within the first fixed outer shaft 84*c*.

In operation, to adjust the height of the adjustable shaft assembly 84*c*, the slidable inner shaft 116*c* is adjusted to a desired height, the set screw 124*c* is then disposed through the at least one hole 120*c* formed within the outer fixed shaft peripheral edge 122*c* and is then adjusted to frictionally engage the slidable inner shaft 116*c* and prevent vertical movement of the slidable inner shaft 116*c* with respect to the outer fixed shaft 84*c*.

Similar to the shaft and base assembly 82*b* described with respect to FIGS. 4-5, the shaft assembly 82*c* shown in FIGS. 6-7 includes a garbage can retaining loop member 98*c*, a garbage can retaining hook 96*c*, and a T-shaped flange 106*c*. Also, the shaft assembly 82*c* includes a base 86*c* and a locking tab 88*c*.

When oriented in a vertical position and inserted into the base 86*c* that is fixably secured to the ground for use in holding or storing a garbage can, the slidable inner shaft 116*c* is vertically oriented above the lower end 102*c* of the outer fixed shaft 84*c*.

In an embodiment of the invention shown in FIGS. 8-11, the garbage can retaining device 92*d* has a shaft and base assembly 82*d* includes a shaft support assembly 128*d* includes two fixed shaft assemblies 84*d*, 84*d*' similar to those disclosed with respect to FIGS. 4-5 and further includes a T-shaped member 130*d* integrally formed with a lower end 102*d*, 102*d*' of each fixed shaft assembly 84*d*, 84*d*' and with the base 86*d*. The T-shaped member 130*d* has a horizontal support bar 132*d* that is parallel to a ground surface when mounted within the mounting member 30 and a perpendicular support bar 134*d* perpendicular to the horizontal support bar 132*d* that has a lower portion 136*d* either integrally or removably formed with the base 86*d*. Similar to the locking tab 88*b* described with respect to FIGS. 4-5, the shaft and base assembly 82*d* shown in FIGS. 8-11 further includes a locking tab 88*d* that may be integrally formed with the lower portion 136*d* of the perpendicular support bar 134*d* and the base 86*d*, or may be integrally formed with either the base 86*d* or the lower portion 136*d* of the perpendicular support bar 134*d* for engaging the shaft and base assembly 82*d* with the mounting member 30 (shown in FIG. 8).

Similar to the shaft and base assembly 82*b* described with respect to FIGS. 4-5, the shaft assembly 82*d* shown in FIGS. 8-11 includes a respective garbage can retaining loop member 98*d*, 98*d*', a respective garbage can retaining hook 96*d*, 96*d*' and a respective T-shaped flange 106*d*, 106*d*'.

Figure 8:
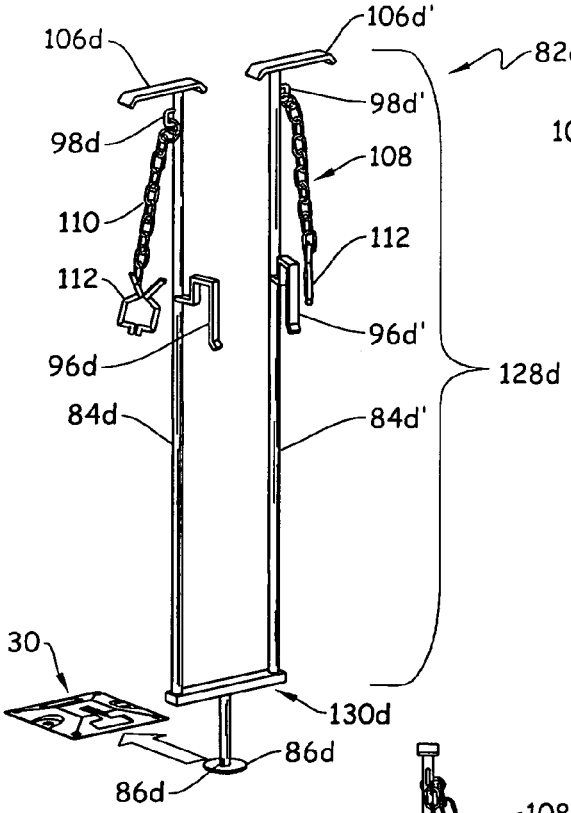
FIG. 8 illustrates a perspective view of a shaft and base assembly adapted to slidably mount within a mounting member in accordance with an embodiment of the invention.

FIG. 8 illustrates a perspective view of the shaft and base assembly 82*d* adapted to slidably mount within the mounting member 30.

Figure 9:
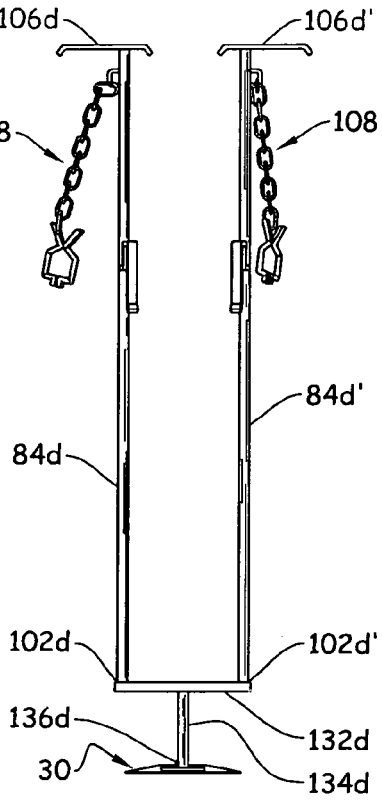
FIG. 9 illustrates a front plan view of the garbage can retaining device including the shaft and base assembly shown in FIG. 8 mounted within the mounting member.

FIG. 9 illustrates a front plan view of the garbage can retaining device 92*d* including the shaft and base assembly 82*d* shown in FIG. 8 mounted within the mounting member 30.

Figure 10:
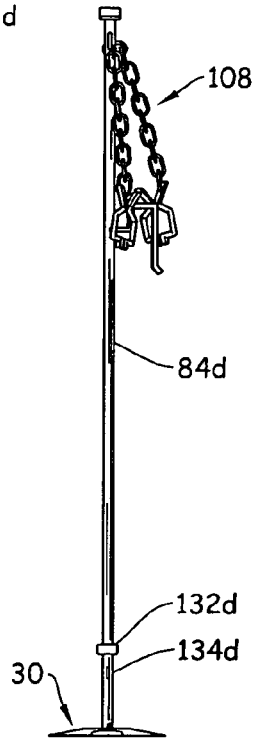
FIG. 10 illustrates a side elevational view of the garbage can retaining device shown in FIG. 9.

FIG. 10 illustrates a side elevational view of the garbage can retaining device 92*d* shown in FIG. 9.

Figure 11:
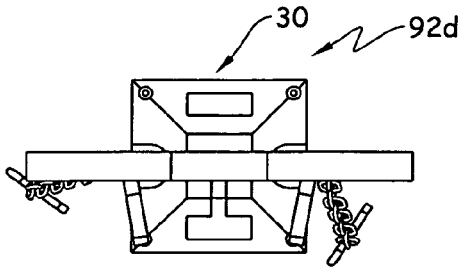
FIG. 11 illustrates a top plan view of the of the garbage can retaining device shown in FIG. 9.

FIG. 11 illustrates a top plan view of the of the garbage can retaining device 92*d* shown in FIG. 9.

Figure 12:
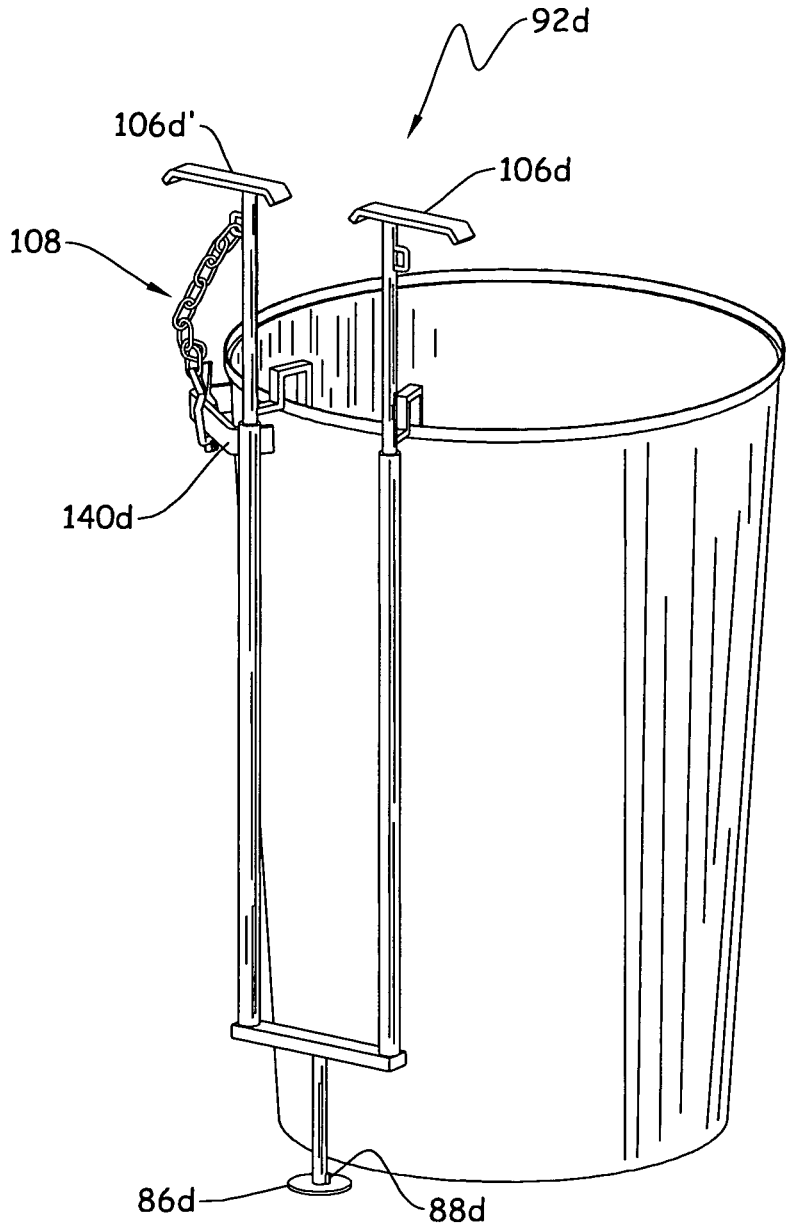
FIG. 12 illustrates a perspective view of the garbage can retaining device described with respect to FIGS. 8-11 in use with an empty garbage can not in use and being stored in a desired location such as a garage.

FIG. 12 illustrates a perspective view of the garbage can retaining device 92*d* described with respect to FIGS. 8-11 in use with a garbage can having a handle 140*d*.

FIGS. 13-16 illustrate an embodiment of the invention including a garbage can retaining device 92*e* with a shaft and base assembly 82*e* and two an adjustable shaft assemblies 114*e*, 114*e*' similar to those described with respect to FIGS. 6-7 that also include two flanges 106*e*, 106*e*', two loop members 98*e*, 98*e*', two hook members 96*e*, 96*e*' each associated with a respective inner shaft 116*e*, 116*e*' that is in telescopic engagement with a respective outer fixed shaft 84*e*, 84*e*' and a respective set screw 124*e*, 124*e*'. The adjustable shaft assemblies 114*e*, 114*e*' are integrally formed with a T-shaped member 130*e* similar to the T-shaped member 130*d* described with respect to FIGS. 8-11. Each of the hook members 98*e*, 98*e*' may engage a clasping member 108 having an associated chain 110 and vice grip 112.

Figure 13:
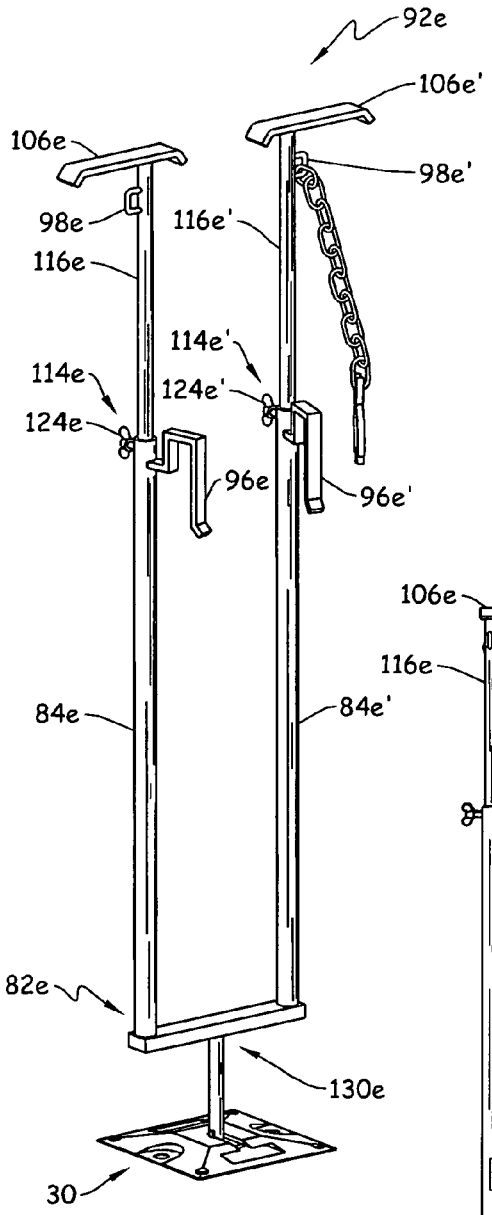
FIG. 13 illustrates a perspective view of a garbage can retaining device having the shaft and base assembly mounted within a mounting member in accordance with an embodiment of the invention.

FIG. 13 illustrates a perspective view of the garbage can retaining device 92*e* having the shaft and base assembly 82*e* mounted within the mounting member 30.

Figure 14:
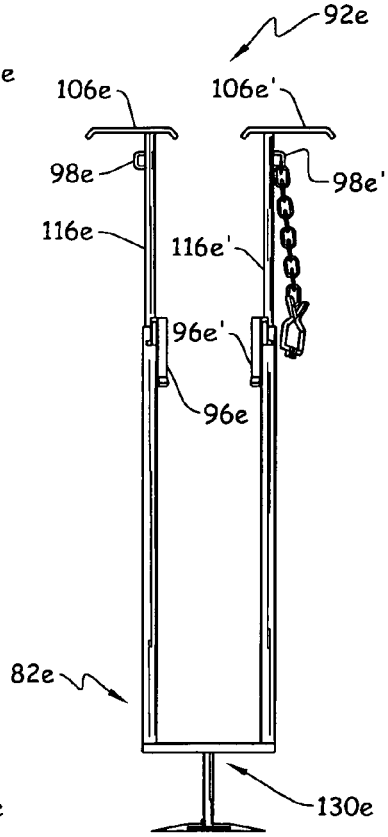
FIG. 14 illustrates a front plan view of the garbage can retaining device shown in FIG. 13.

FIG. 14 illustrates a front plan view of the garbage can retaining device 92*e* shown in FIG. 13.

Figure 15:
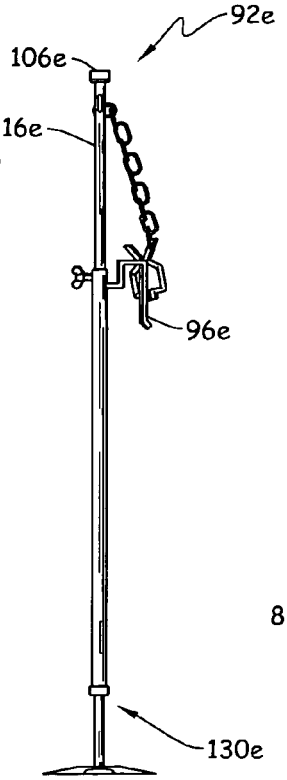
FIG. 15 illustrates a side elevational view of the garbage can retaining device shown in FIG. 13.

FIG. 15 illustrates a side elevational view of the garbage can retaining device 92*e* shown in FIG. 13.

Figure 16:
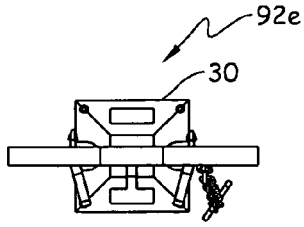
FIG. 16 illustrates a top plan view of the garbage can retaining device shown in FIG. 13.

FIG. 16 illustrates a top plan view of the garbage can retaining device 92*e* shown in FIG. 13.

In an embodiment of the invention shown in FIGS. 17-20, 23-32, and 33-42, a garbage can retaining device (92*f* shown in FIGS. 17-20, 92*g* shown in FIGS. 23-32, and 92*h* shown in FIGS. 33-42) is provided including a garbage can contacting portion secured to the shaft that includes a hook member adapted to receive a lip of an inverted garbage can, and a biasing mechanism to bias an inverted garbage can to be retained by the hook member or to be removed from the hook member. In an embodiment of the invention, the biasing mechanism includes a pivot assembly adapted to removably retain a lip of a top portion of an inverted and empty garbage can therein.

In an embodiment of the invention shown in FIGS. 17-20, a garbage can retaining device 92*f* is provided including a shaft 84*f* that includes a locking tab 88*f* integrally formed with the shaft 84*f* and slidably receivable by the locking tab slot 38, and a garbage can contacting portion 145 that includes a hook member 142 and a biasing mechanism to bias an inverted garbage can to be retained by the hook member or to be removed from the hook member, wherein the pivot assembly 144 is biased to removably retain a lip of a top portion of an inverted and empty garbage can therein. Additionally, in an embodiment of the invention, the pivot assembly is biased via a linkage assembly 146.

Figure 19:
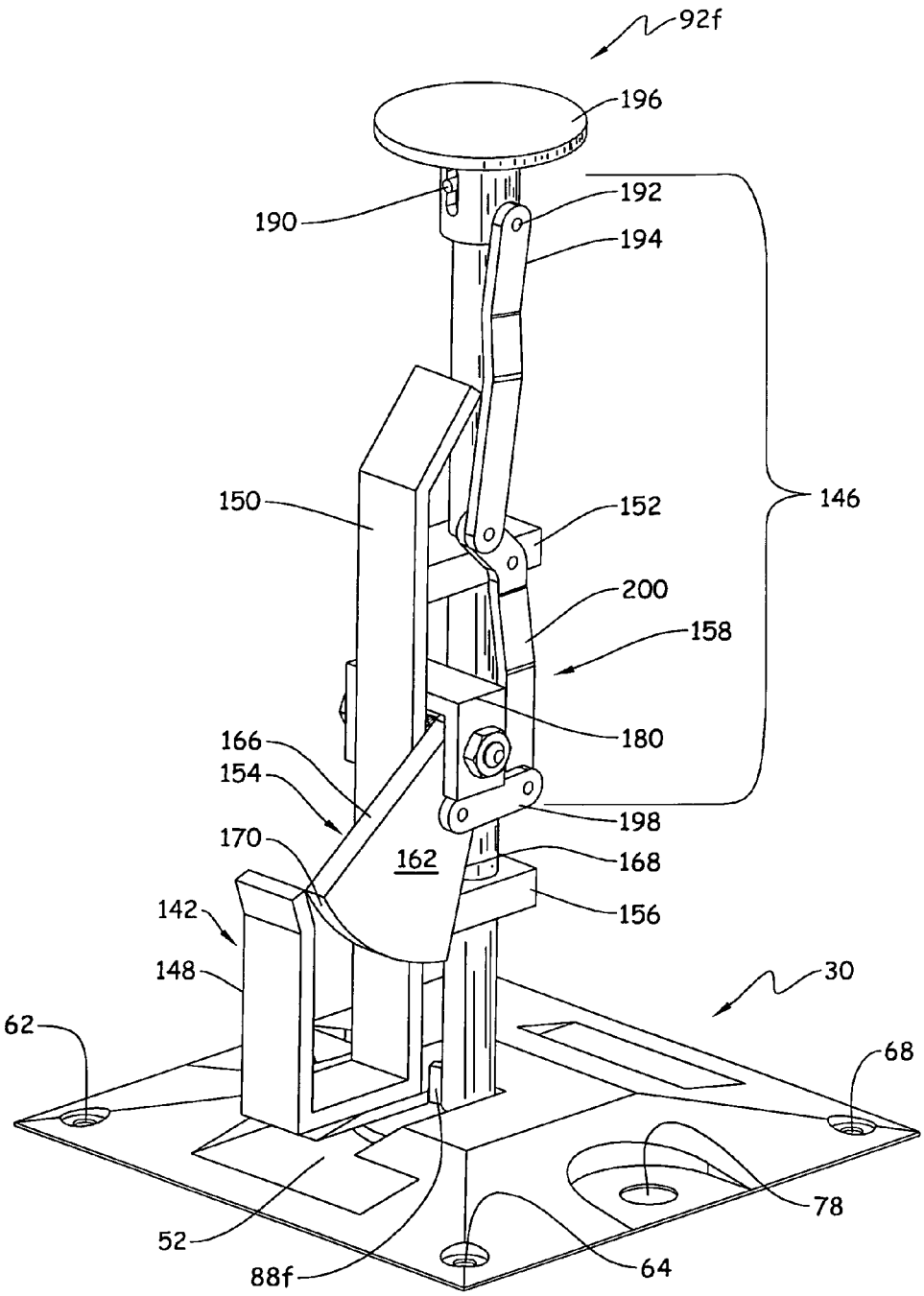
FIG. 19 illustrates a perspective view of the garbage can retaining device illustrating a linkage assembly and a pivot assembly.
Figure 20:
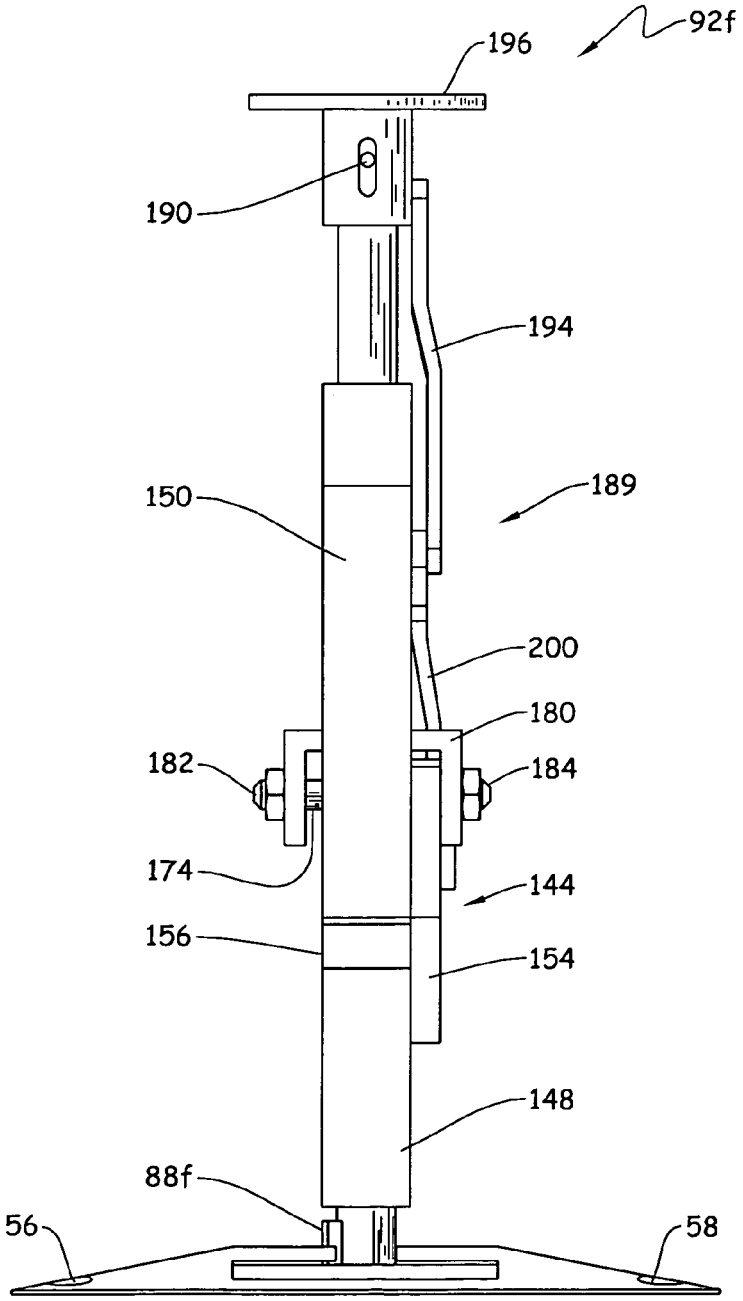
FIG. 20 illustrates a front view of the garbage can retaining device shown in FIGS. 18-19.
Figure 21:
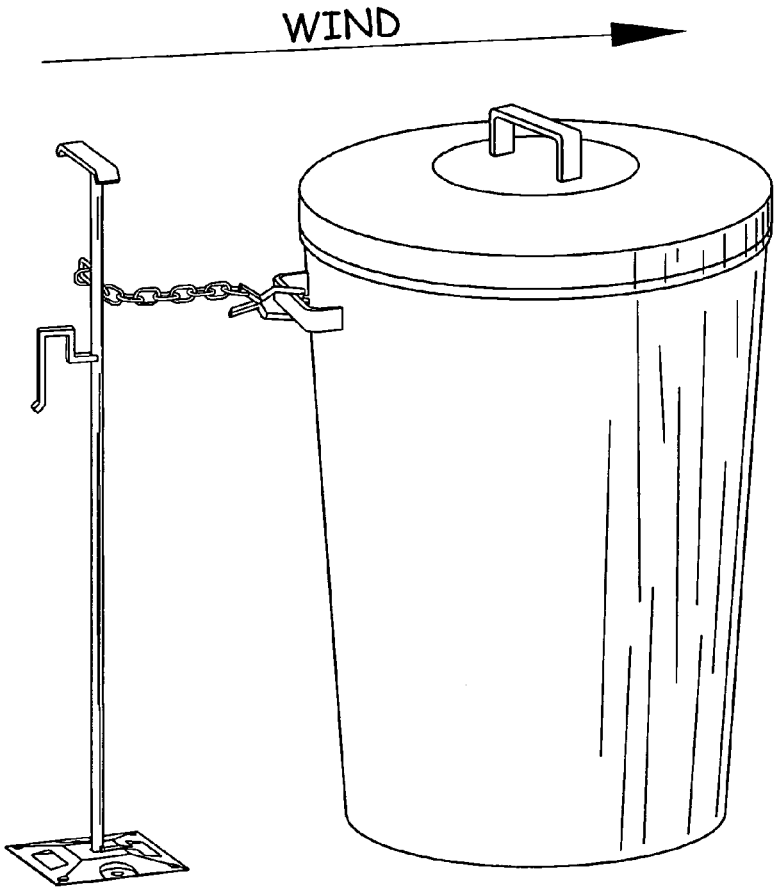
FIG. 21 illustrates a perspective view of an embodiment of the present invention retaining a garbage can.
Figure 22:
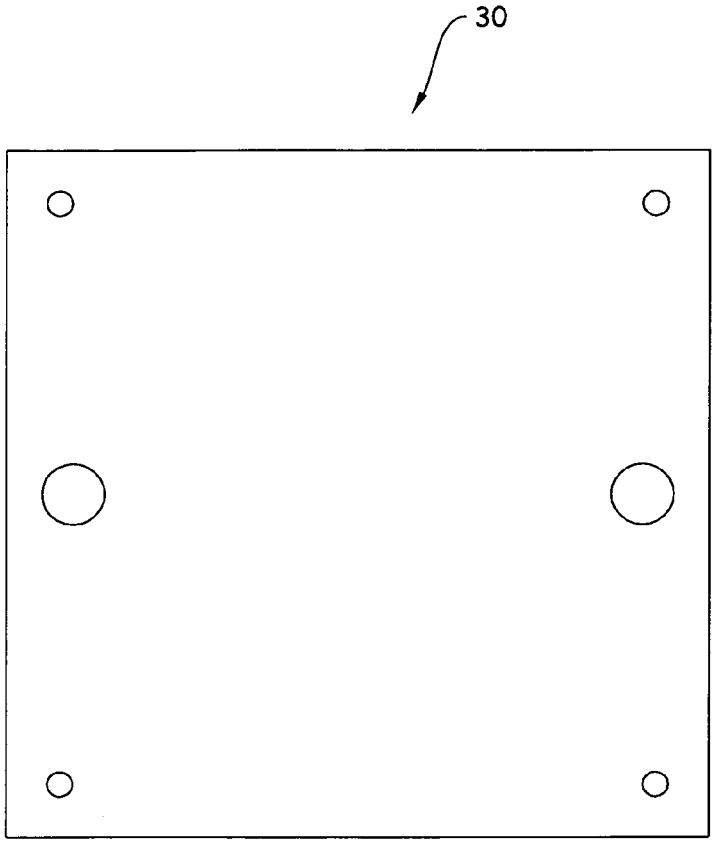
FIG. 22 illustrates a bottom plan view of a mount.

FIG. 17 illustrates a perspective view of the garbage can retaining device 92*f* with the hook member 142 shown in phantom to further show the details of the pivot assembly 144. FIG. 18 illustrates a perspective view of the garbage can retaining device 92*f* including the hook member 142 as a solid. FIG. 19 illustrates a perspective view of the garbage can retaining device 92*f* illustrating a linkage assembly 146 and pivot assembly 144 FIG. 20 illustrates a front view of the garbage can retaining device 92*f* shown in FIGS. 18-20.

In an embodiment of the invention, the hook member 142 has a u-shaped lip hook 148 (shown in FIGS. 18-20, and in phantom in FIG. 17), a hook member mounting plate 152 (shown in FIGS. 17-19), and an elongated portion 150 that is integrally formed with the shaft 84*f* via the hook member mounting plate 152. When the garbage can contacting portion 145 is mounted within the mount member 30 such that the shaft 84*f* is in a vertical position perpendicular to a ground surface, the elongated portion 150 of the hook member 142 extends upwardly from the u-shaped lip hook 148 towards the hook member mounting plate 152. The hook member 142 may be permanently secured to the hook member mounting plate 152 by any suitable attachment means such as, but not limited to welding.

Referring now in particular to FIGS. 17-20, a pivot assembly 144 is adapted to bias a lip of a garbage can therein, wherein the pivot assembly 144 includes a pivot biased to apply pressure to an edge of the pivot against an outer surface of an inverted garbage can or a lip of a top portion of an inverted and empty garbage can held in position by the u-shaped garbage can lip hook. In an embodiment of the invention, the pivot assembly is biased by a bias trigger switch that moves from a first non-biasing position to a second biasing position, and is unbiased by the bias trigger switch that moves from the second biasing position to the first non-biasing position, thereby removing the pressure of the pivot against the garbage can outer surface. Additionally, the biasing mechanism includes a linkage assembly 146 adapted to bias the pivot assembly 144 in mechanical engagement with the linkage assembly 146, wherein the linkage assembly in mechanical engagement with the bias trigger switch to control movement of the pivot assembly.

In an embodiment of the invention, the pivot assembly 144 has a pivot 154, and a pivot guide 156, that is in mechanical engagement with a pivot biasing device 158. In an embodiment of the invention, the pivot 154 has two opposing planar sides 160, 162 having wedge-shaped contours bounded by a peripheral wall 164 having respective two side peripheral edges 166, 168 and an end peripheral edge 170 between the two planar sides 160, 162, where a thickness of the pivot 154 is defined by the width of the peripheral wall 164 extending between the two planar sides 160, 162. Each wedge-shaped opposing planar side 160, 162 defining a respective narrow tapered portion having a first pivot hole 172 disposed therethrough for receiving a pivot bar 174 and a second pivot hole 176 disposed therethrough for receiving a pivot stop pin 178 and a respective opposing flared portion adapted to contact an outer surface of a garbage can at the end peripheral edge 170 of the pivot 154 when an inverted garbage can lip is placed within the garbage can lip hook 148.

The pivot assembly 144 includes a pivot bar mount 180, a pivot bar 174 having two opposing ends and two pivot bar retainers 182, 184 adapted to mate with a respective pivot bar end. The pivot bar mount 180 is integrally formed with the shaft 84*f* beneath the hook member mount 152 by any suitable permanent securement means such as welding to provide a mounting frame for the pivot assembly 144. The pivot bar mount 180 has two holes disposed therethrough to receive the pivot bar 174 therethrough, wherein the pivot bar is removably secured to the pivot bar mount when the pivot assembly 144 is assembled together, and the pivot bar 174 is initially disposed through one of the two pivot bar mount holes, a tension spring 186 having a protruding portion 188 is friction fit on the pivot bar 174. The pivot 154 is then placed adjacent the protruding portion 188 of the tension spring 186 when the pivot bar 174 is disposed through the pivot hole to retain the pivot thereon. Once the tension spring 186 and the pivot 154 are assembled to the pivot bar 174, the pivot bar 174 respectively is disposed through each of the pivot bar mount holes. Then, each of the two pivot bar retainers 182, 184 respectively engage a one of the two opposing ends to prevent movement of the pivot bar 174 within the pivot bar mount 180.

A pivot guide 156 is integrally formed with the shaft 84*f* below the pivot bar mount 180 to properly guide the pivot 154 along the Y-Z plane and to prevent movement of the pivot in the X direction along the X-Y plane.

The pivot bias device 158 includes the tension spring 186 mounted on the pivot bar 174, and a locking arm device 189.

The locking arm device 189 includes a three part linkage (linkage assembly 146) and a bias trigger switch 190 in communication with a set screw 192. The three part linkage assembly 146 includes an upper linkage 194 that pivotably engages the set screw 192, wherein the set screw 192 retains the upper linkage 194 to an upper cap member 196 integrally formed at a top end of the shaft 84*f* and a stop 198 for the pivot 154 that includes a pivot stop pin 178 protruding inwardly toward the shaft 84*f* away from a planar portion of the stop when disposed through the second pivot stop pin hole 176 of the pivot 154 to contact the protruding portion 188 of the tension spring 186 to stop movement of the pivot 154 along the Y-Z plane. A lower linkage 200 is disposed between the upper linkage 194 and the pivot stop 198 as shown in FIG. 19 to allow for movement of the locking arm device 189. The bias trigger switch 190 moves between a first non-biasing position and a second biasing position.

The hook member 142 cooperates with the pivot assembly 144 to removably retain a lip of a garbage can therein. The pivot assembly 144 is biased to apply pressure to an edge of the pivot 170 against an outer surface of a garbage can when a lip of a top portion of an inverted and empty garbage can is held in position by the u-shaped garbage can lip hook 148. To unbias the pivot assembly 144 and thereby remove the pressure of the pivot 154 against the garbage can outer surface, a bias trigger switch 190 is moved to the first non-biasing position from the second biasing position. The garbage can may then be easily removed from the device by an upward lifting movement to disengage the lip from the garbage can lip hook 148.

In an embodiment of the invention shown in FIGS. 23-32, a garbage can retaining device 92*g* is provided including a garbage can mounting portion 210 that includes a hook member 142 and pivot assembly 212 adapted to removably retain a lip of a top portion of an inverted and empty garbage can therein.

Figure 23:
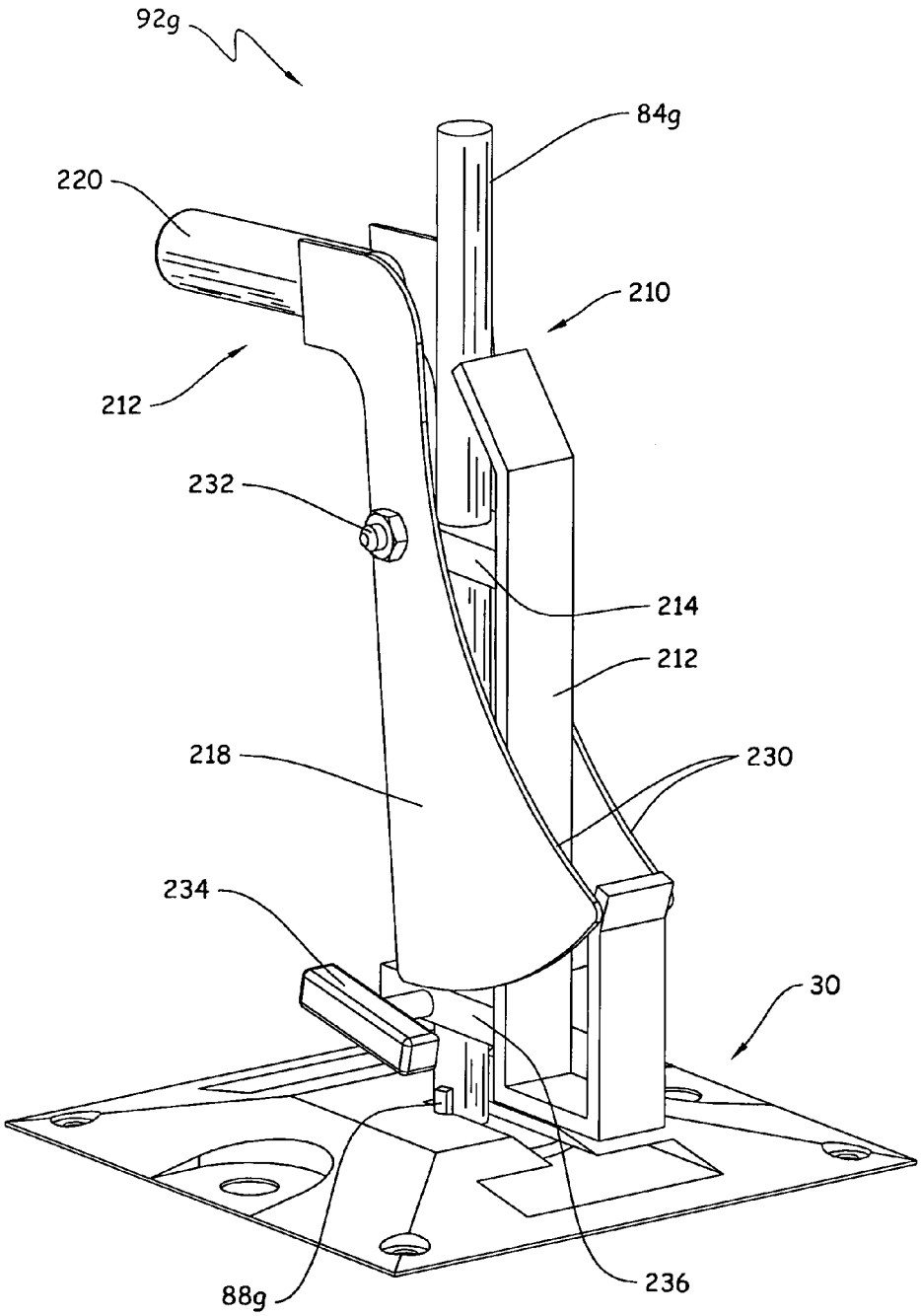
FIG. 23 illustrates a perspective view of a mount having a shaft and garbage can mounting portion in a biased position including a pivot assembly including a counterweight in accordance with an embodiment of the invention.
Figure 24:
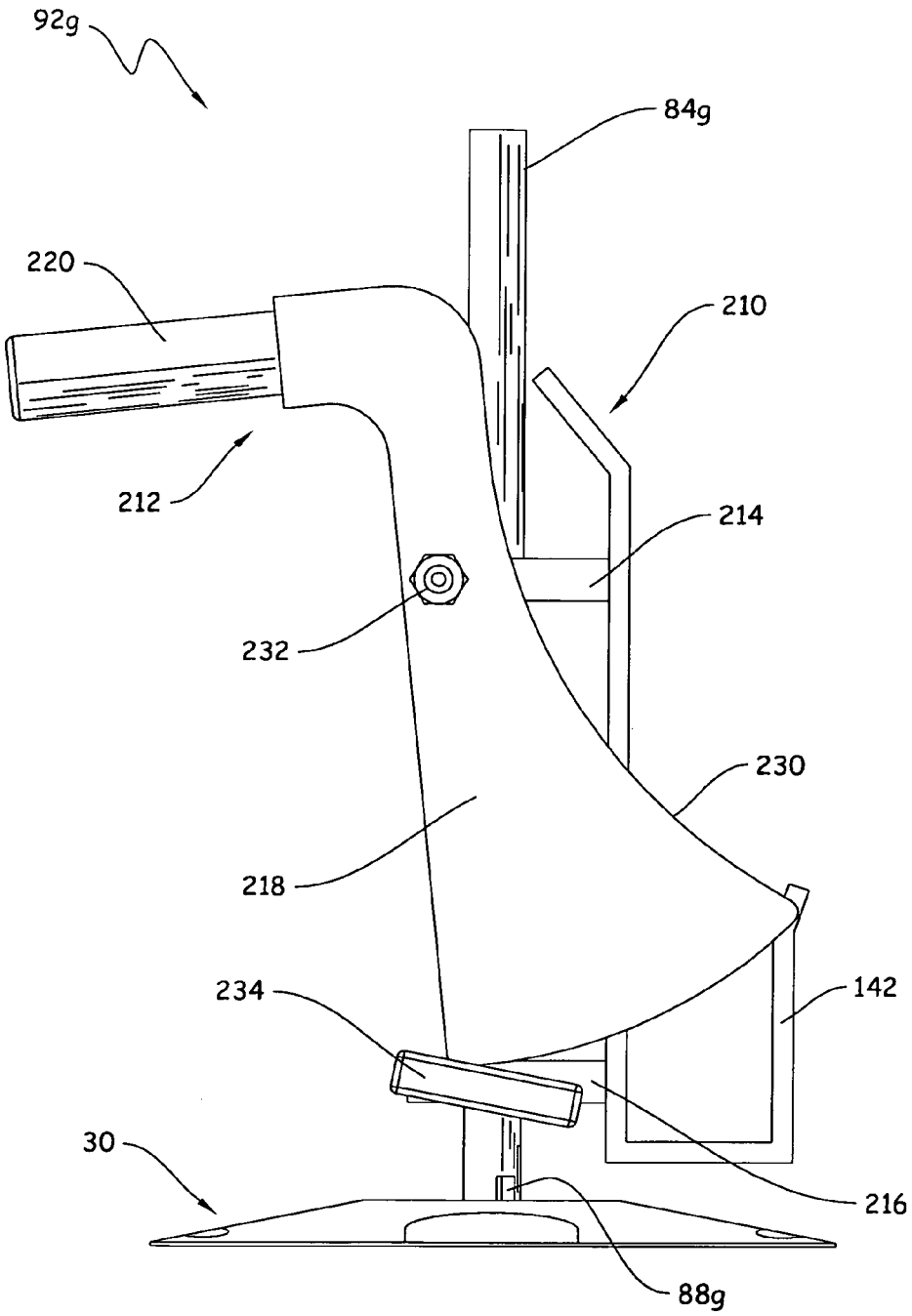
FIG. 24 illustrates a side elevational view of the garbage can retaining device including the shaft and garbage can mounting portion in a biased position shown in FIG. 23 mounted within the mounting member.
Figure 25:
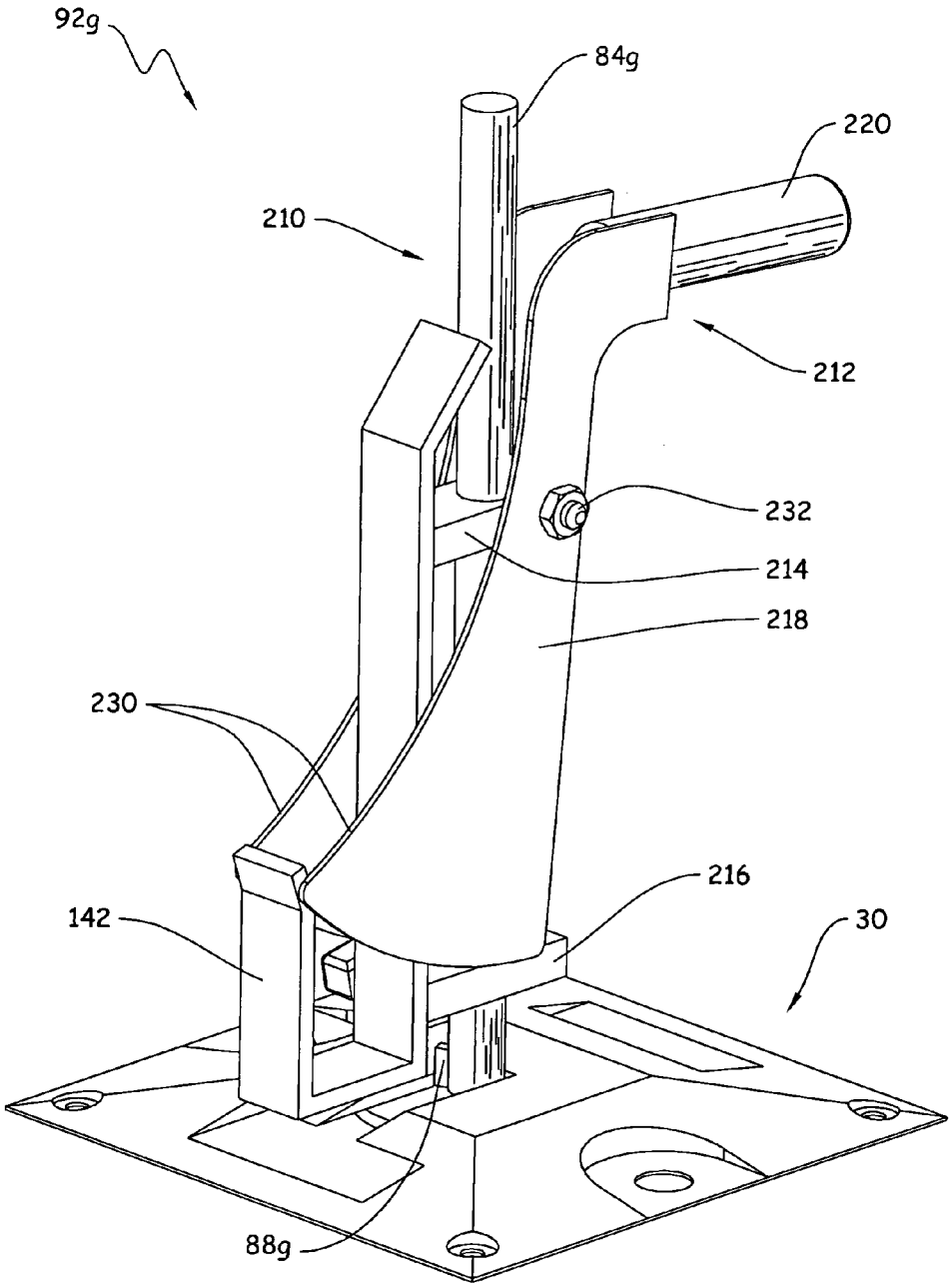
FIG. 25 illustrates a perspective view of the garbage can retaining device shown in FIG. 23.
Figure 26:
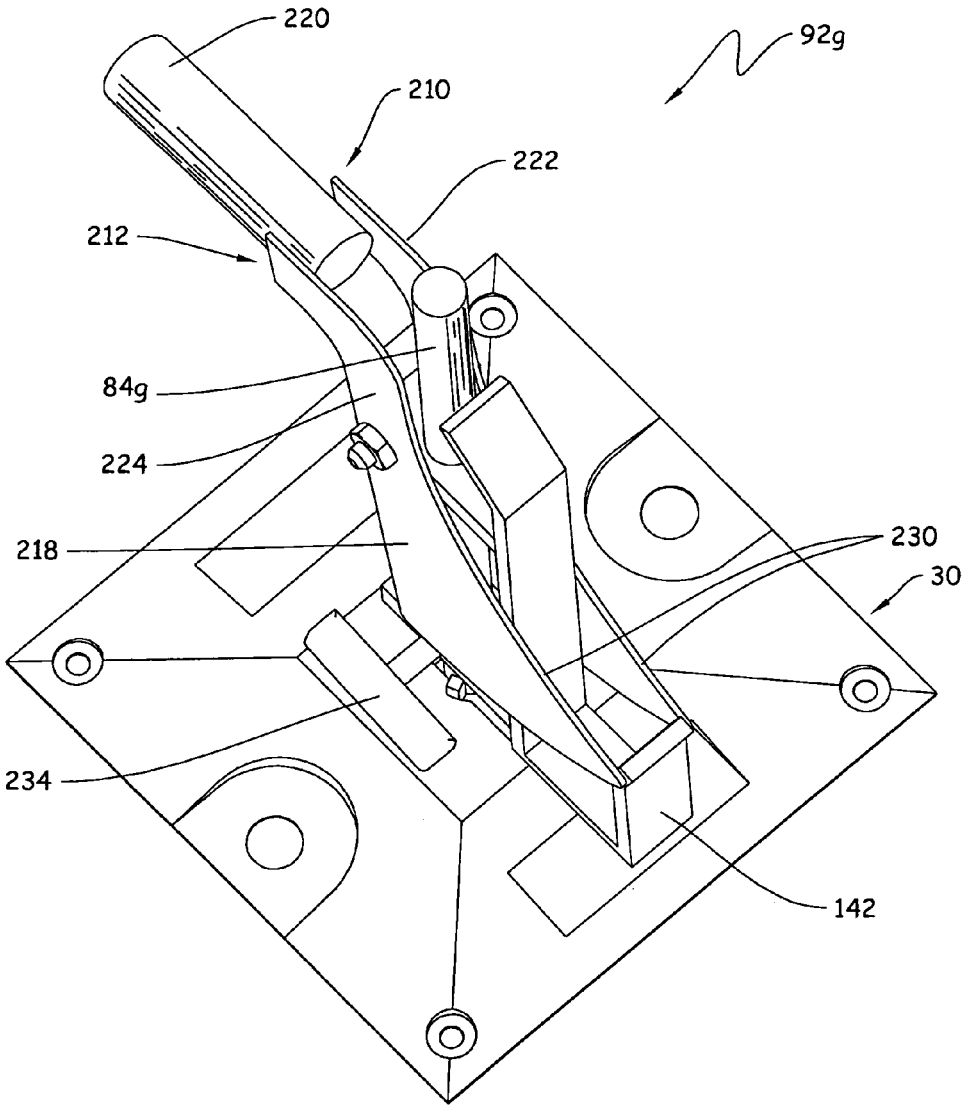
FIG. 26 illustrates a perspective view of the of the garbage can retaining device shown in FIG. 23.
Figure 27:
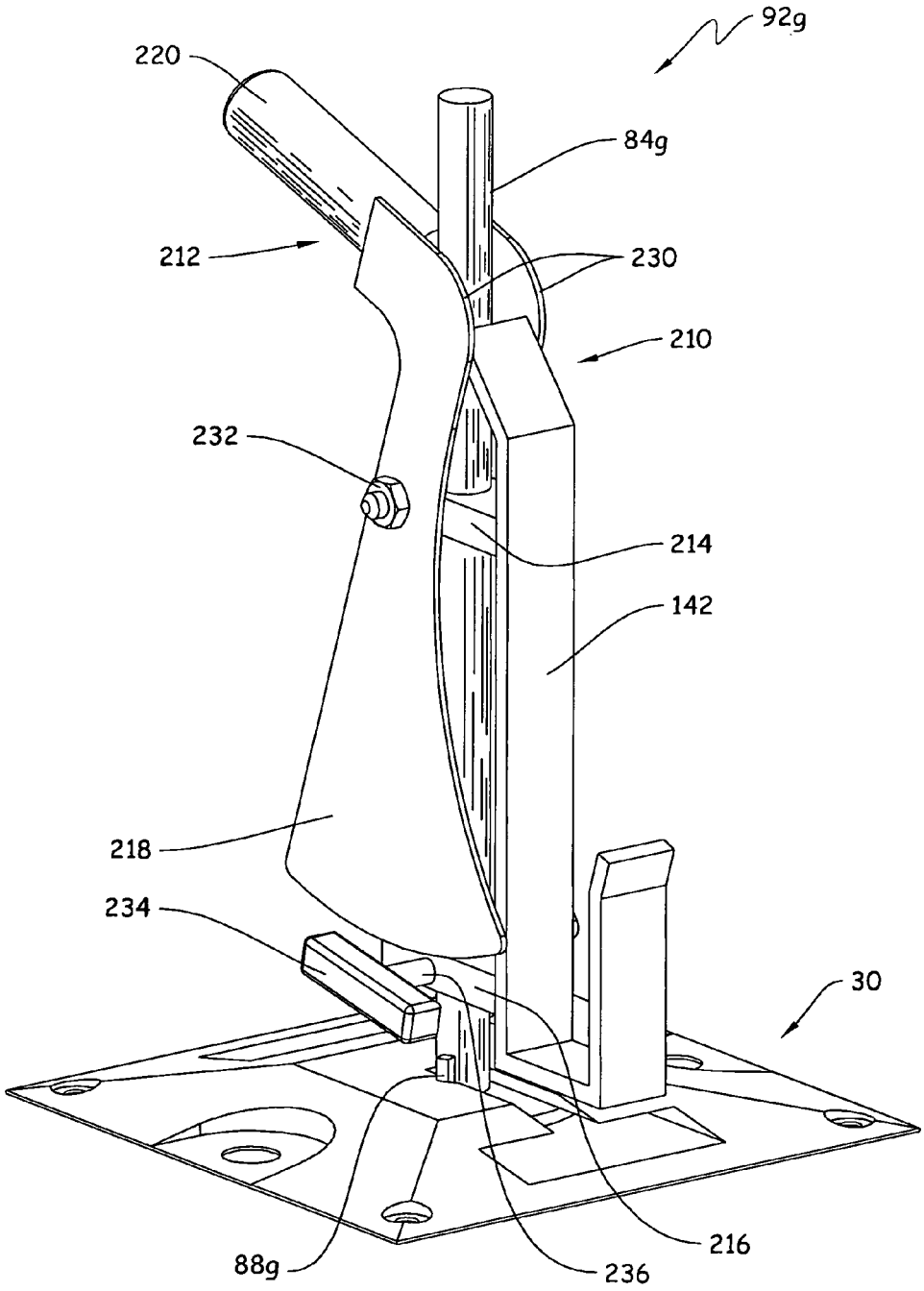
FIG. 27 illustrates a perspective view of a mount having a shaft and garbage can mounting portion in an unbiased position including a pivot assembly including a counterweight in accordance with an embodiment of the invention.
Figure 28:
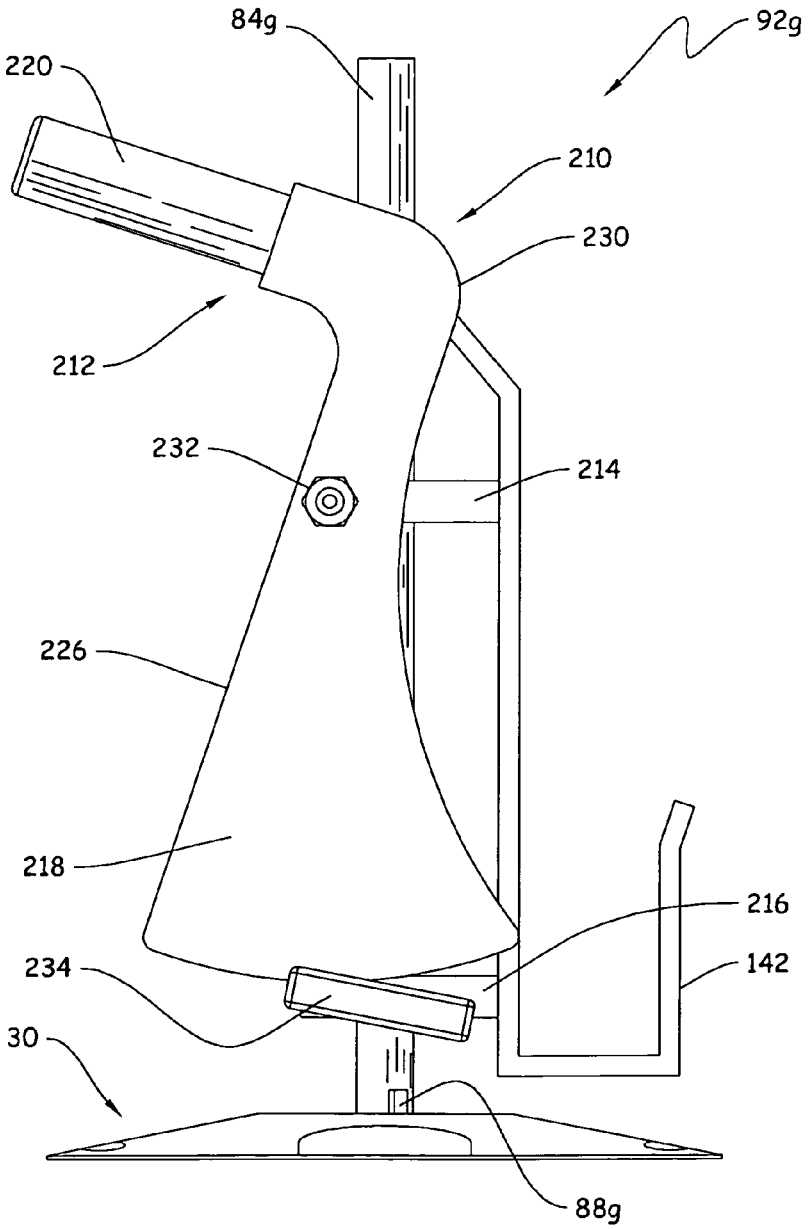
FIG. 28 illustrates a side elevational view of the garbage can retaining device including the shaft and garbage can mounting portion in an unbiased position shown in FIG. 27 mounted within the mounting member.
Figure 29:
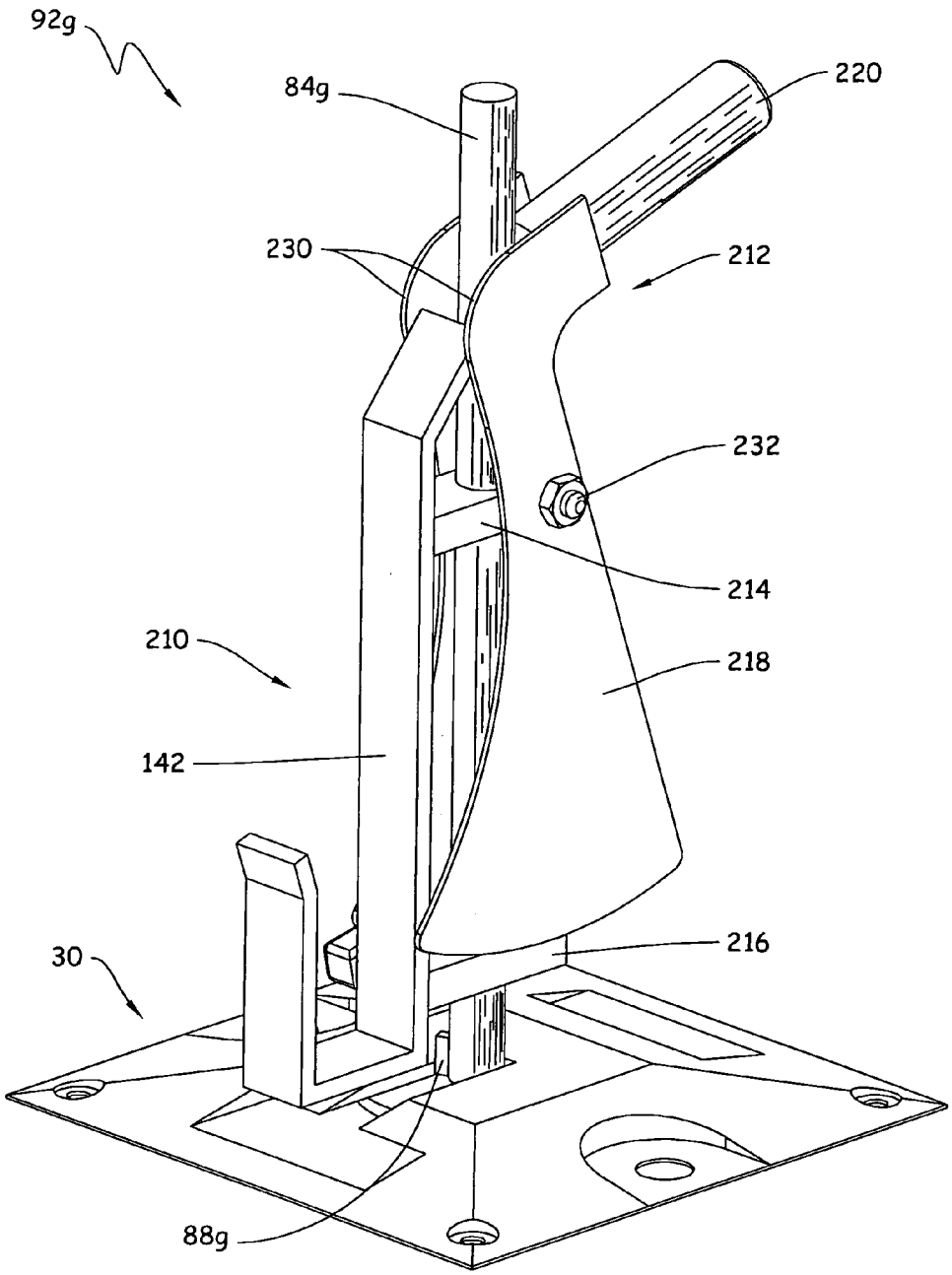
FIG. 29 illustrates a perspective view of the garbage can retaining device shown in FIG. 27.
Figure 30:
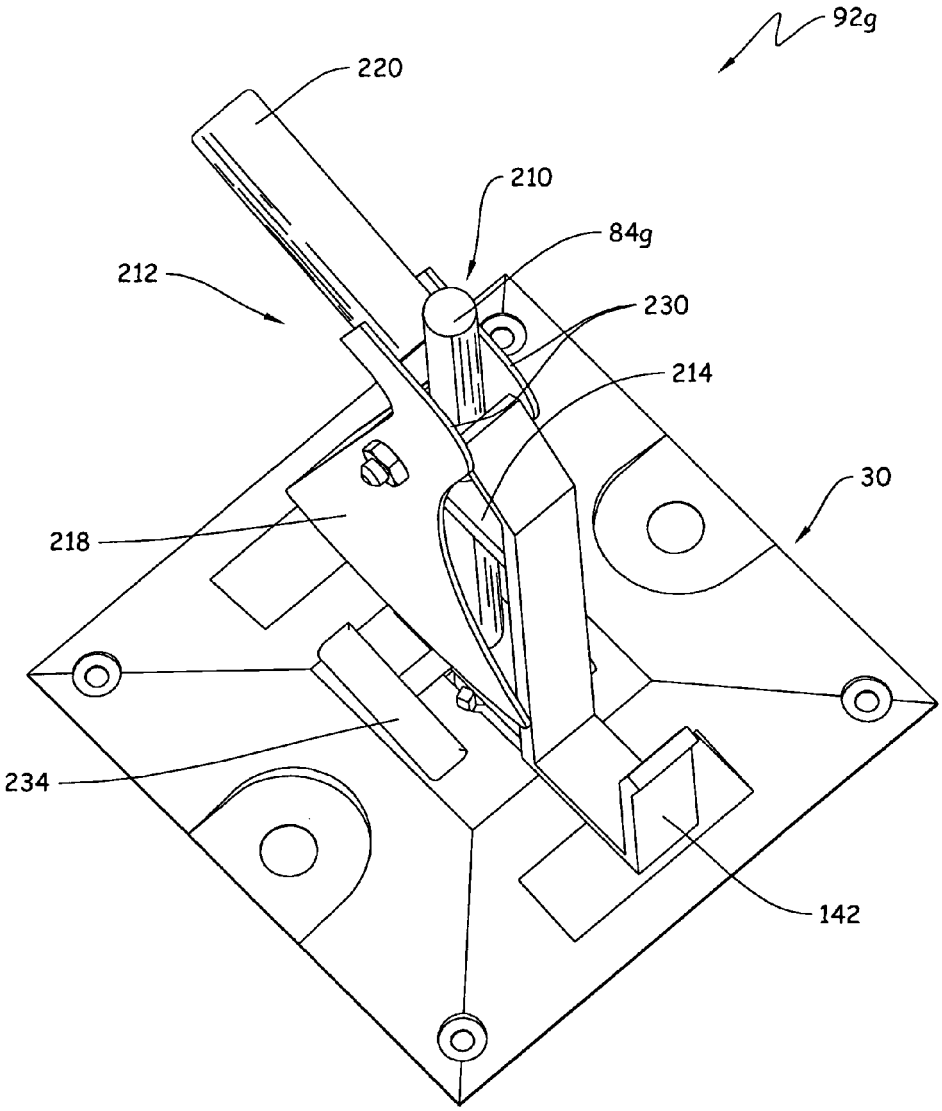
FIG. 30 illustrates a perspective view of the of the garbage can retaining device shown in FIG. 27.
Figure 31:
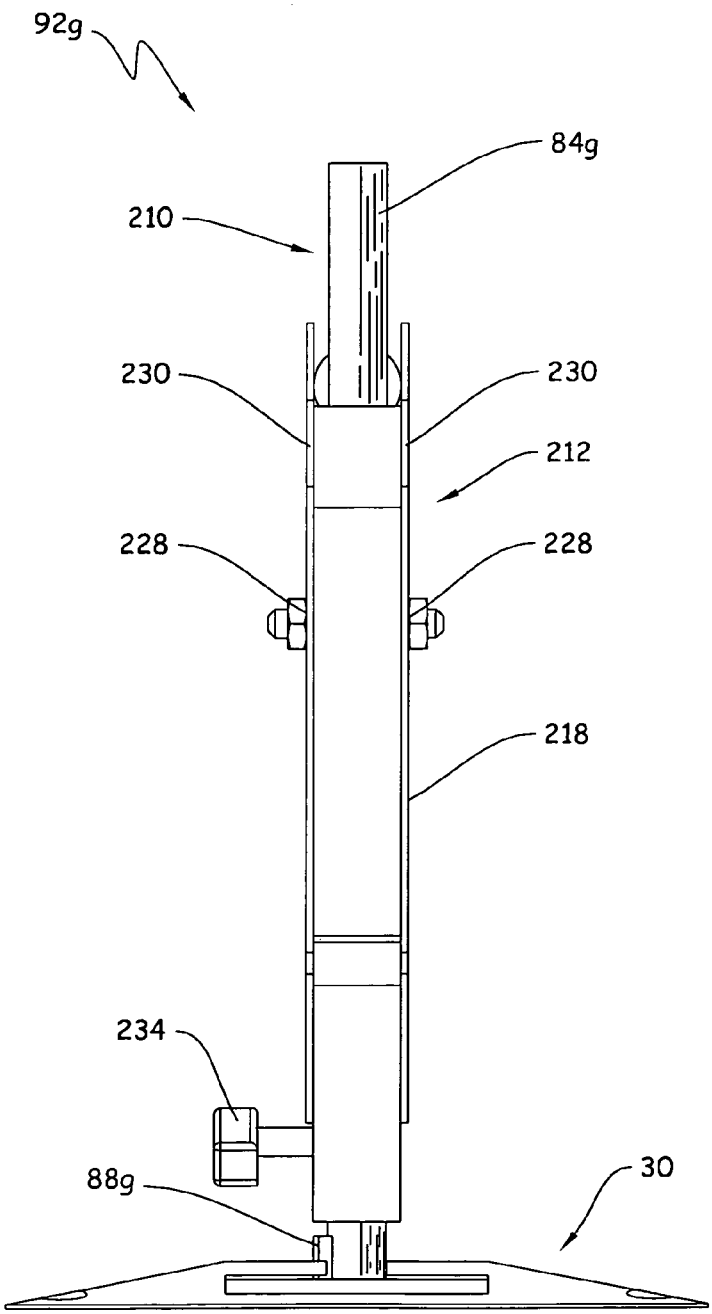
FIG. 31 illustrates a front plan view of the garbage can retaining device shown in FIGS. 23-30.
Figure 32:
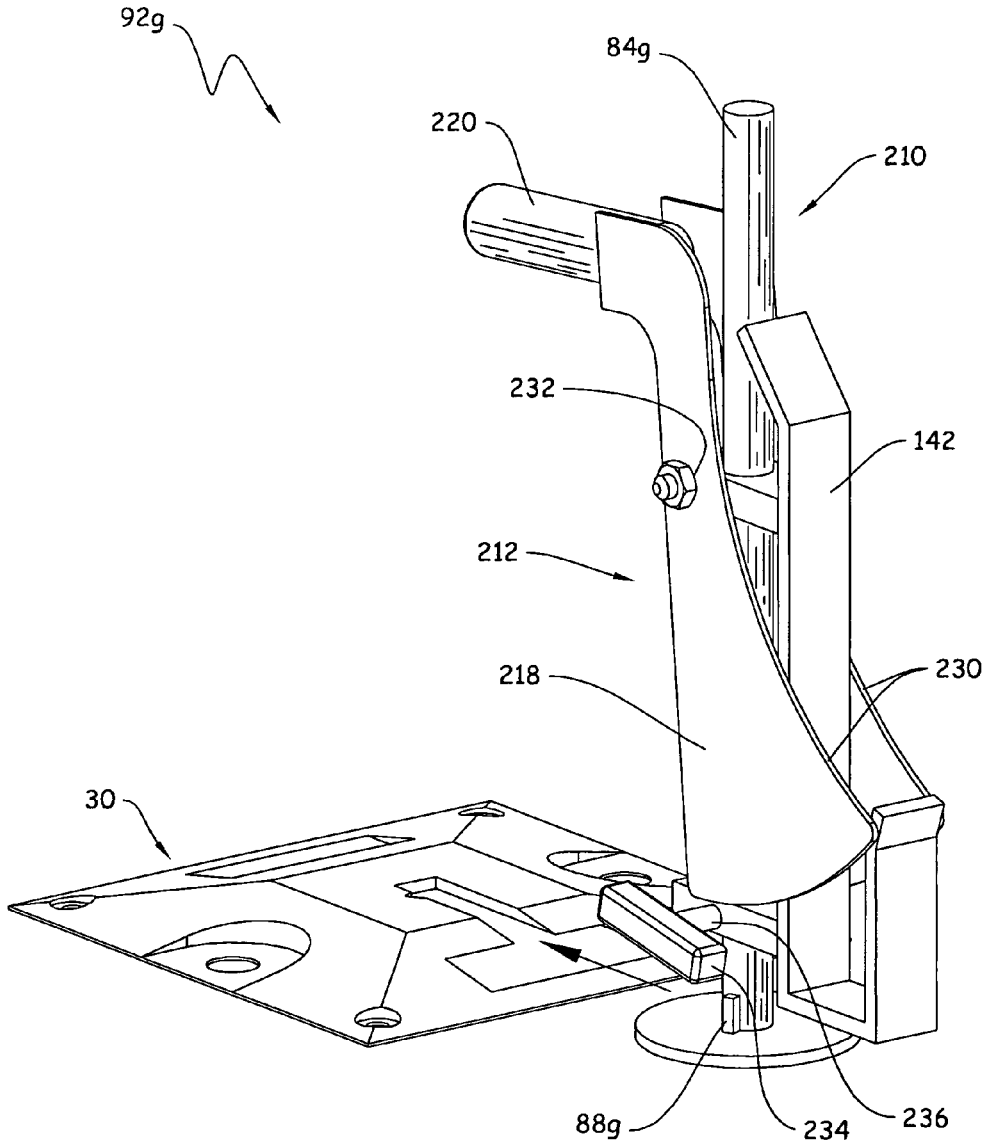
FIG. 32 illustrates a perspective view of a shaft and garbage can mounting portion including a pivot assembly including a counterweight adapted to slidably mount within a mounting member in accordance with an embodiment of the invention.

In an embodiment of the invention, the hook member 142 has a u-shaped lip hook 148 and an elongated portion 150 that is integrally formed with the shaft 84*g* via an upper hook member mounting plate 214 and a lower hook member mounting plate 216 (shown in FIGS. 23-25). When the garbage can mounting portion 210 is mounted within the mount member 30 such that the shaft 84*g* is in a vertical position perpendicular to a ground surface, the elongated portion 150 of the hook member 142 extends upwardly from the u-shaped lip hook 148 towards the upper hook member mounting plate 214 and lower hook member mounting plate 216. The hook member 142 may be permanently secured to the upper hook member mounting plate 214 and lower hook member mounting plate 216 by any suitable attachments means such as, but not limited to welding.

Referring now in particular to FIGS. 23-32, the pivot assembly 212 has a biasing mechanism including a pivot assembly 212 including a pivot 218 and a counterweight 220. In an embodiment of the invention, the pivot 218 has two opposing planar walls 222, 224 having wedge-shaped contours separated by a distance approximately equal to the width of the hook member 142 and an adjacent planar wall 226 attached to the opposing planar wall (222 or 224) and separating the opposing planar walls 222, 224 an approximate distance of the hook member 142. Each wedge-shaped opposing planar wall 222, 224 defining a respective narrow tapered portion having a pivot hole 228 disposed therethrough for receiving a pivot bar 174 and a respective opposing flared portion adapted to contact an outer surface of a garbage can at a peripheral edge 230 of the opposing planar walls 222, 224 of the pivot 218 when an inverted garbage can lip is placed within the garbage can lip hook 148.

The pivot assembly 212 further includes a pivot bar hole 232 disposed through the upper hook member mounting plate 214, and a pivot bar 174 having two opposing ends and two pivot bar retainers 182, 184 adapted to mate with a respective pivot bar end. The pivot bar hole 232 disposed through the upper hook member mounting plate 214 is disposed to receive the pivot bar 174 therethrough, wherein the pivot bar is removably secured to the upper hook member mounting plate 214 when the pivot assembly 212 is assembled together, and the pivot bar 174 is initially disposed through the pivot bar hole 232. Then, each of the two pivot bar retainers 182, 184 respectively engage a one of the two opposing ends to prevent movement of the pivot bar 174 within the upper hook member mounting plate 214.

The biasing mechanism includes the counterweight 220 mounted to the pivot 218 between the opposing planar walls of the pivot 222, 224 and opposite the flared portions of the opposing planar walls 222, 224. The counterweight 220 may be made from a heavy material such as, but not limited to metal. The counterweight 220 may be permanently secured to the opposing planar walls 222, 224 by any suitable attachments means such as, but not limited to welding.

The hook member 142 cooperates with the pivot assembly 212 to removably retain a lip of a garbage can therein. The pivot assembly 212 is biased to apply pressure to an edge of the pivot 230 against an outer surface of a garbage can when a lip of a top portion of an inverted and empty garbage can is held in position by the u-shaped garbage can lip hook. To unbias the pivot assembly and thereby remove the pressure of the pivot against the garbage can outer surface, the counterweight 220 is manually positioned to a point approximate to the shaft 84*g*. The garbage can may then be easily removed from the device by an upward lifting movement to disengage the lip from the garbage can lip hook 148.

The garbage can mounting portion 210 is vertically adjustable along the shaft 84*g* by means of a set screw 234. A set screw hole 236 is disposed through the lower hook member mounting plate 216. The set screw 234 is disposed within the set screw hole 236 such that the set screw 234 makes contact with the shaft 84*g* when the set screw 234 is rotated to an engaged position and ceases to make contact with the shaft 84*g* when rotated to a disengaged position. When the set screw 234 is rotated into the engaged position, the set screw 234 makes contact with the shaft 84*g* and the garbage can mounting portion 210 is firmly secured to the shaft 84*g*. When the set screw 234 is rotated to the disengaged position, the set screw 234 ceases to make contact with the shaft 84*g* and the can mounting portion 210 may be adjusted vertically along the shaft 84*g*. When the garbage can mounting portion 210 is adjusted, the set screw 234 may be rotated to the engaged position to firmly secure the garbage can mounting portion 210 to the shaft 84*g*.

In an embodiment of the invention shown in FIGS. 33-42, a garbage can retaining device 92*h* is provided including a garbage can mounting portion 238 that includes a hook member 142 and biasing mechanism adapted to removably retain a lip of a top portion of an inverted and empty garbage can therein. The biasing mechanism includes a pivot assembly 240.

Figure 33:
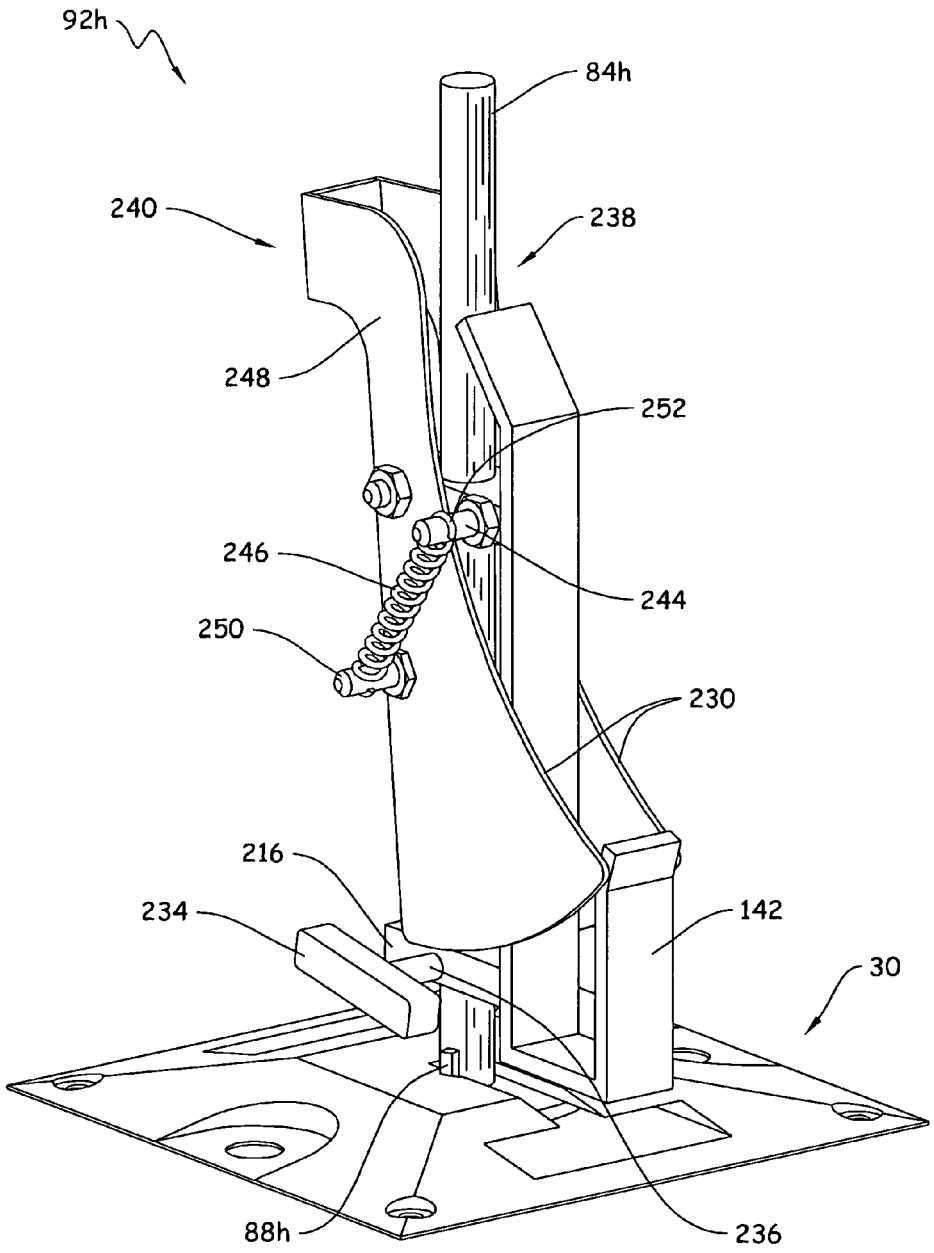
FIG. 33 illustrates a perspective view of a mount having a shaft and garbage can mounting portion in a biased position including a pivot assembly including a tension spring in accordance with an embodiment of the invention.
Figure 34:
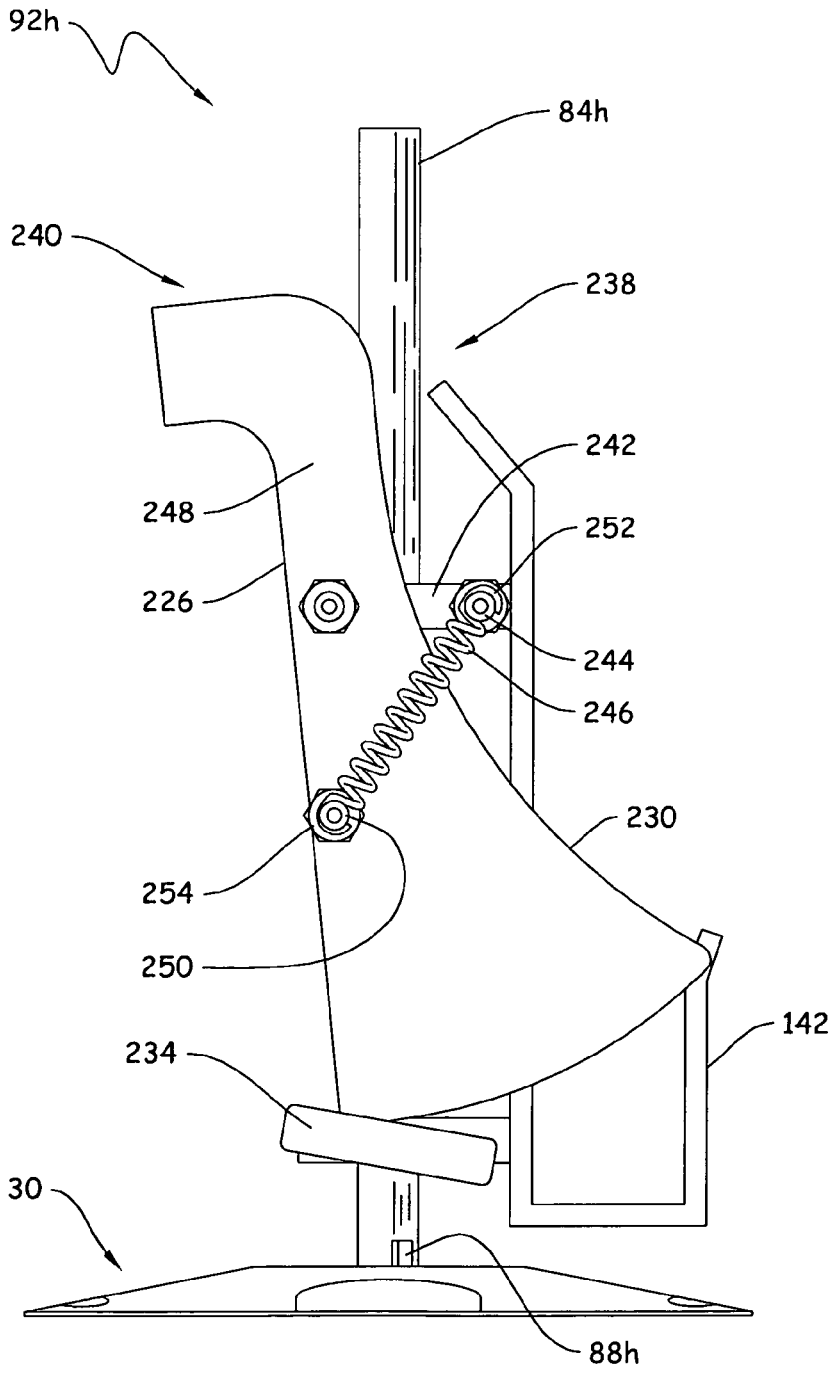
FIG. 34 illustrates a side elevational view of the garbage can retaining device including the shaft and garbage can mounting portion in a biased position shown in FIG. 33 mounted within the mounting member.
Figure 35:
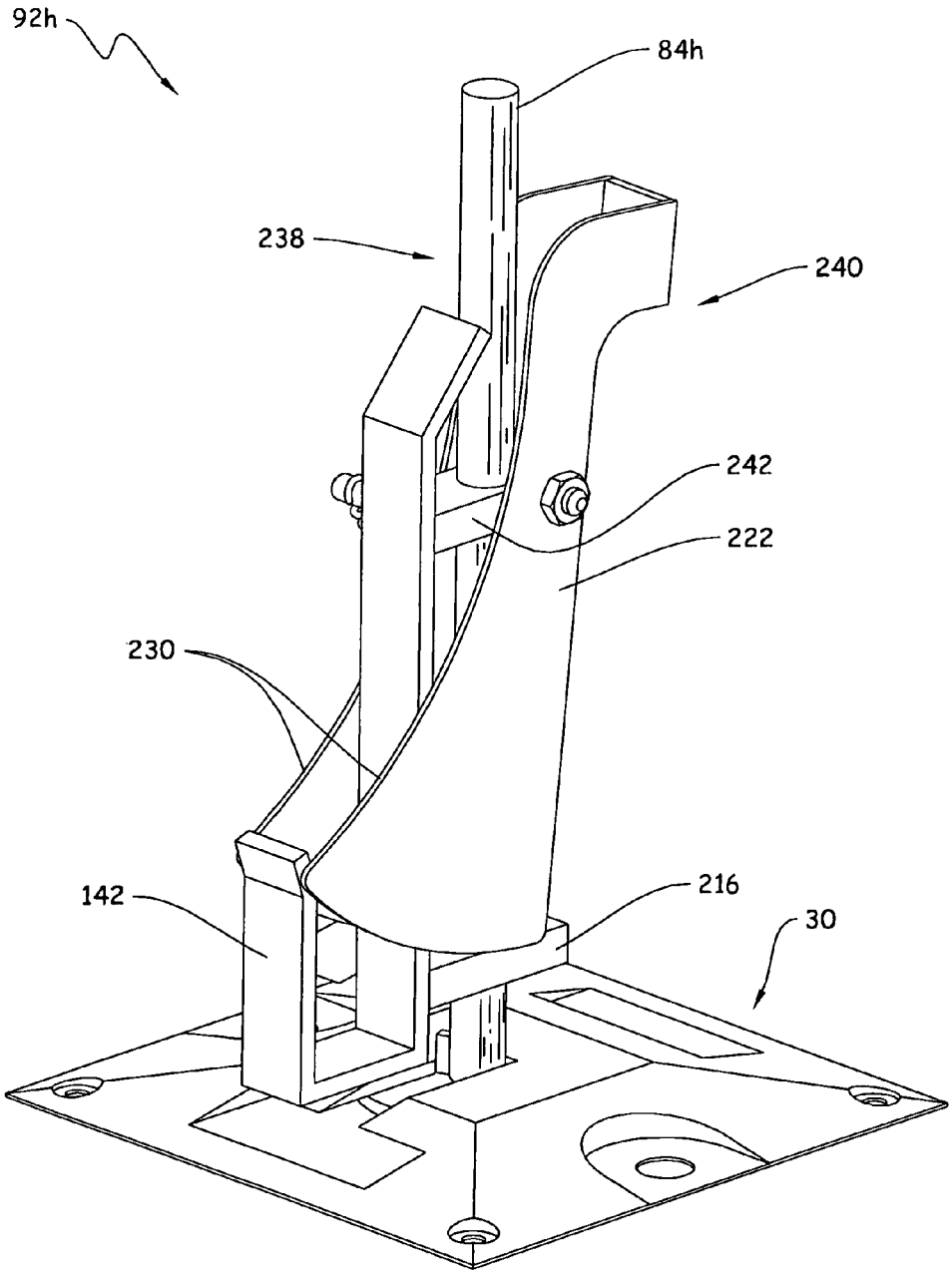
FIG. 35 illustrates a perspective view of the garbage can retaining device shown in FIG. 33.
Figure 36:
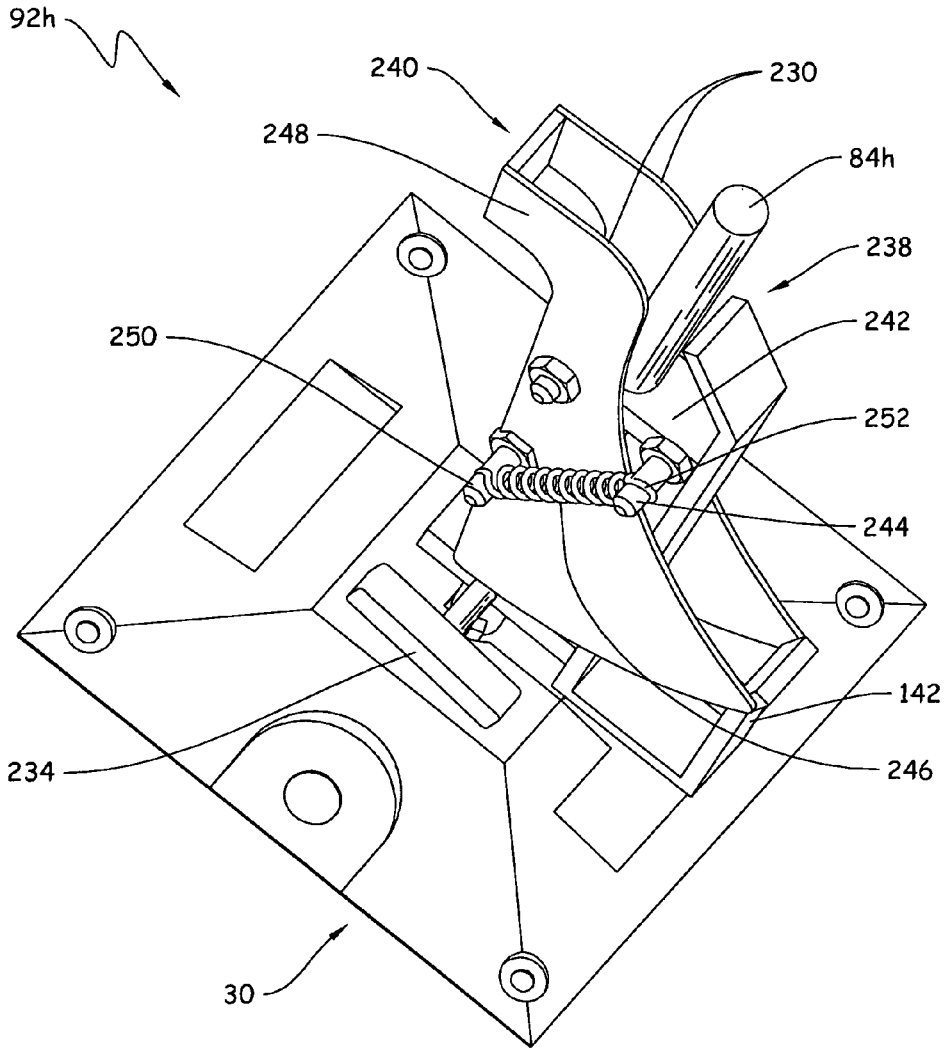
FIG. 36 illustrates a perspective view of the of the garbage can retaining device shown in FIG. 33.
Figure 37:
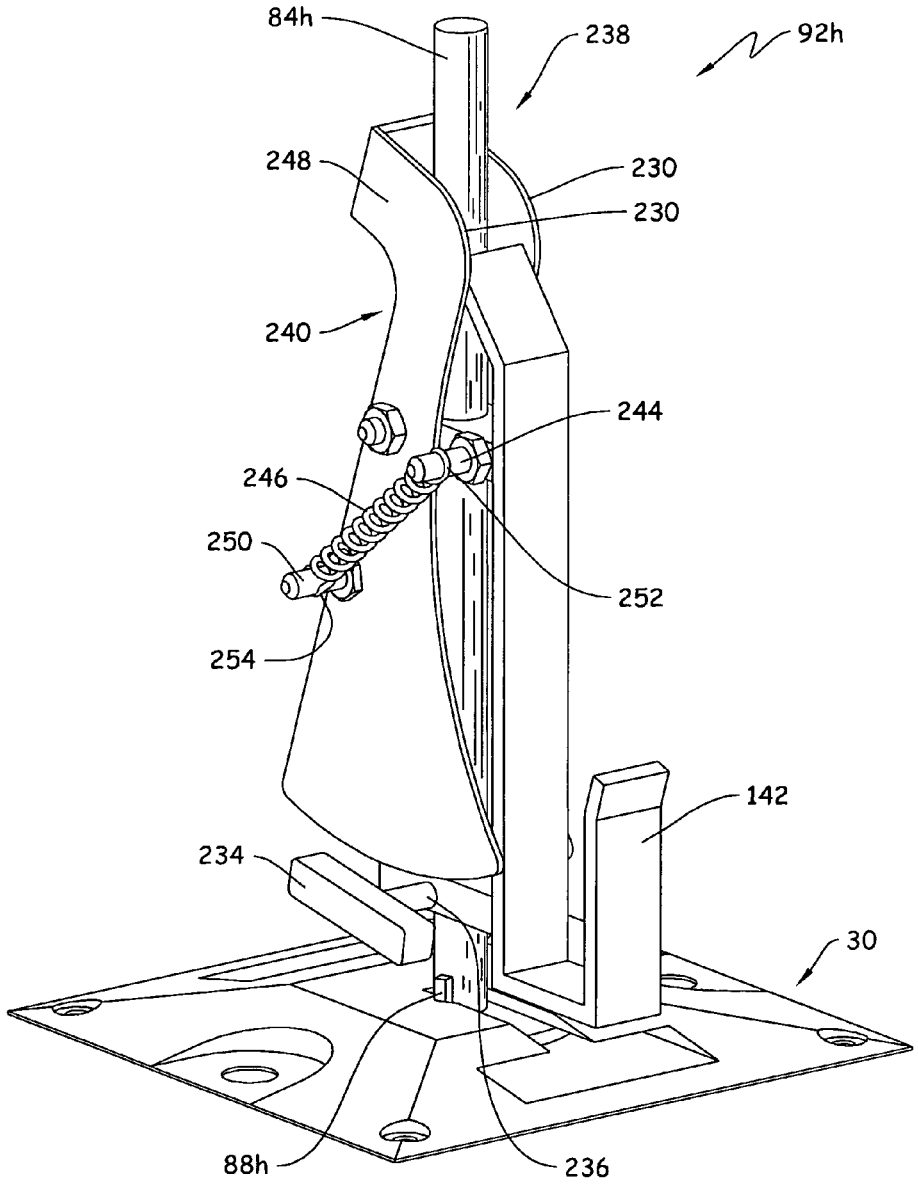
FIG. 37 illustrates a perspective view of a mount having a shaft and garbage can mounting portion in an unbiased position including a pivot assembly including a tension spring in accordance with an embodiment of the invention.
Figure 38:
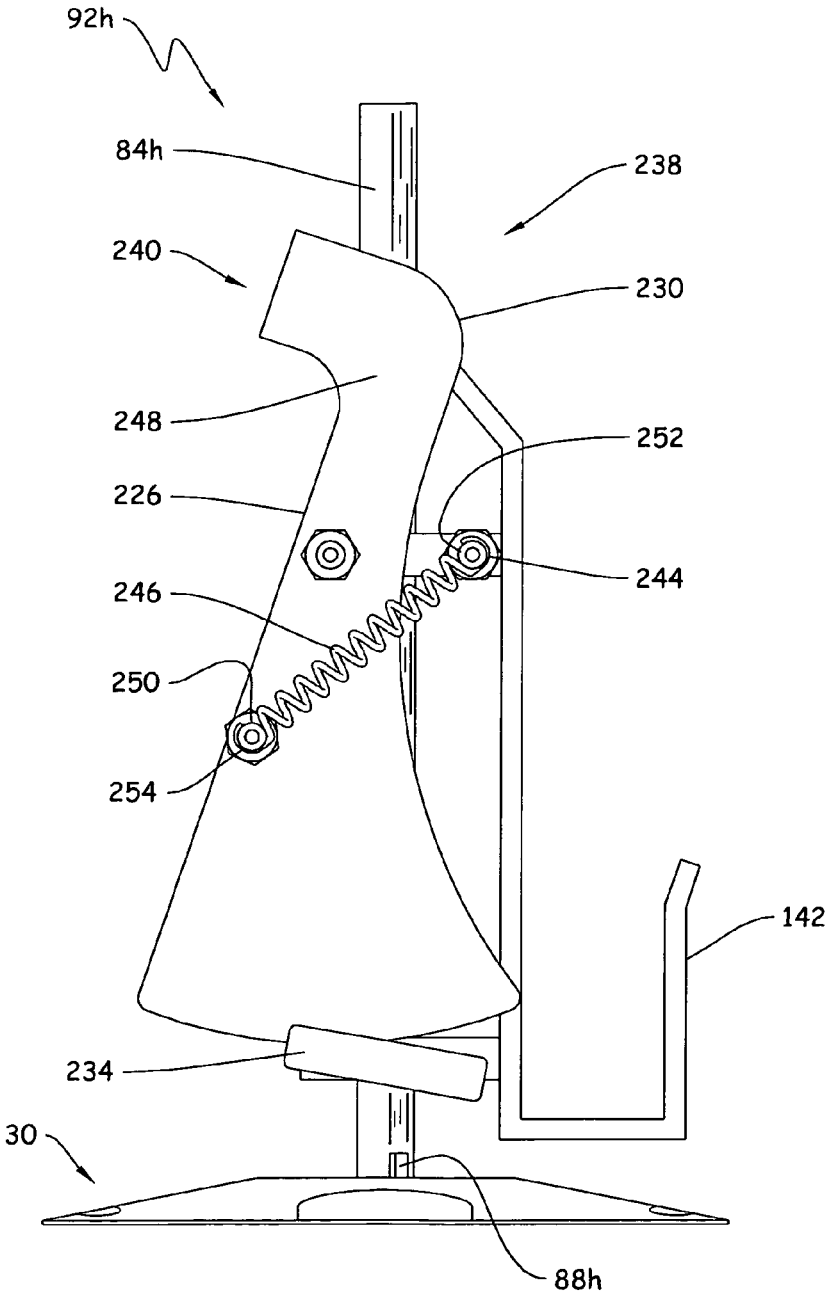
FIG. 38 illustrates a side elevational view of the garbage can retaining device including the shaft and garbage can mounting portion in an unbiased position shown in FIG. 37 mounted within the mounting member.
Figure 39:
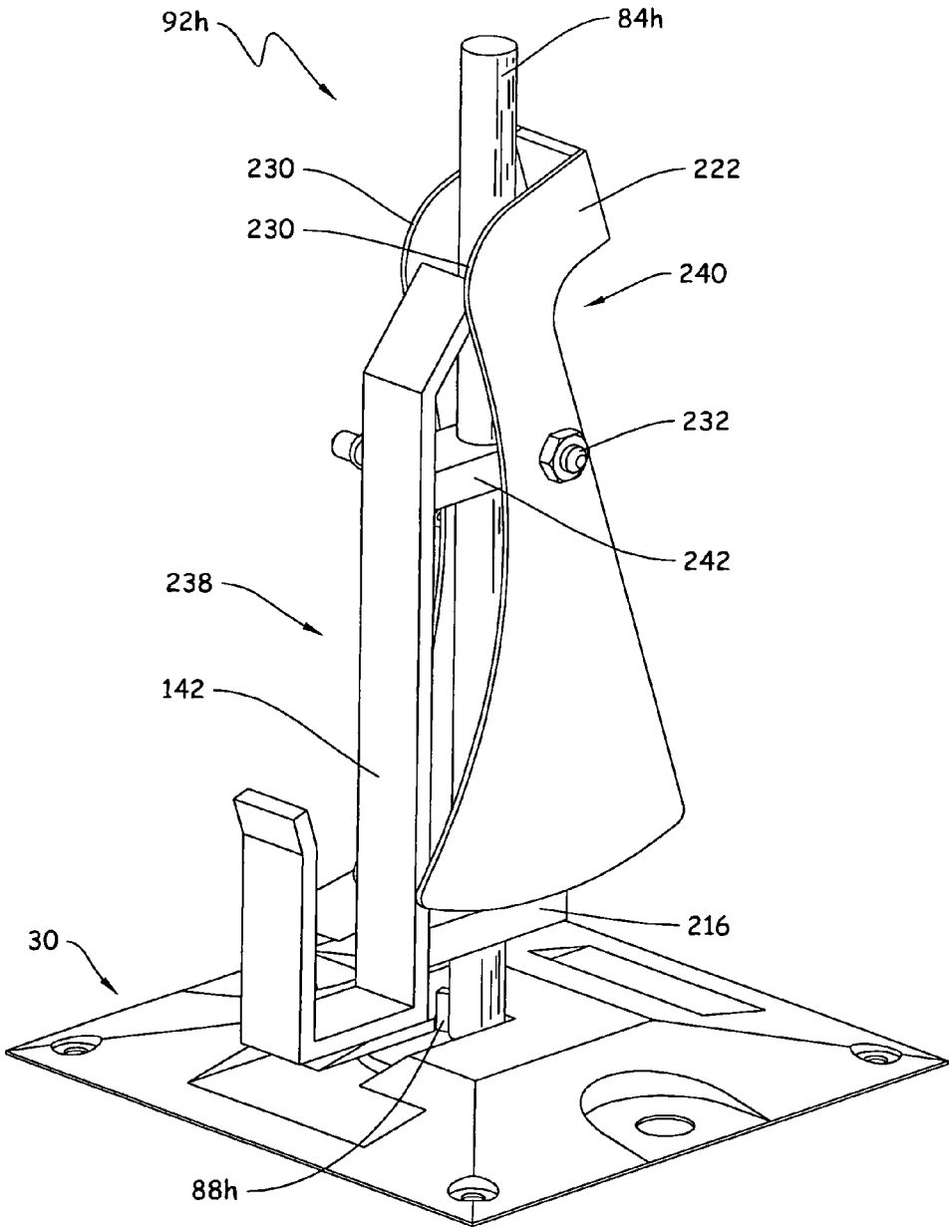
FIG. 39 illustrates a perspective view of the garbage can retaining device shown in FIG. 37.
Figure 40:
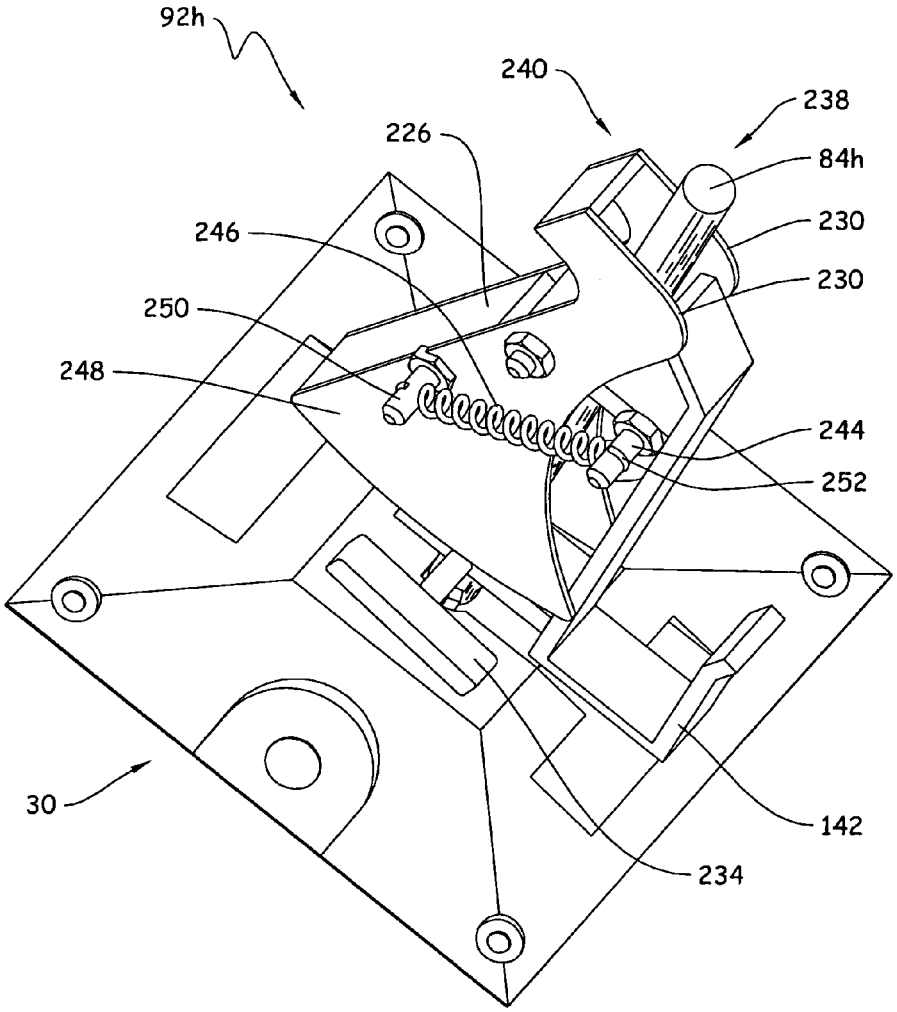
FIG. 40 illustrates a perspective view of the of the garbage can retaining device shown in FIG. 37.
Figure 41:
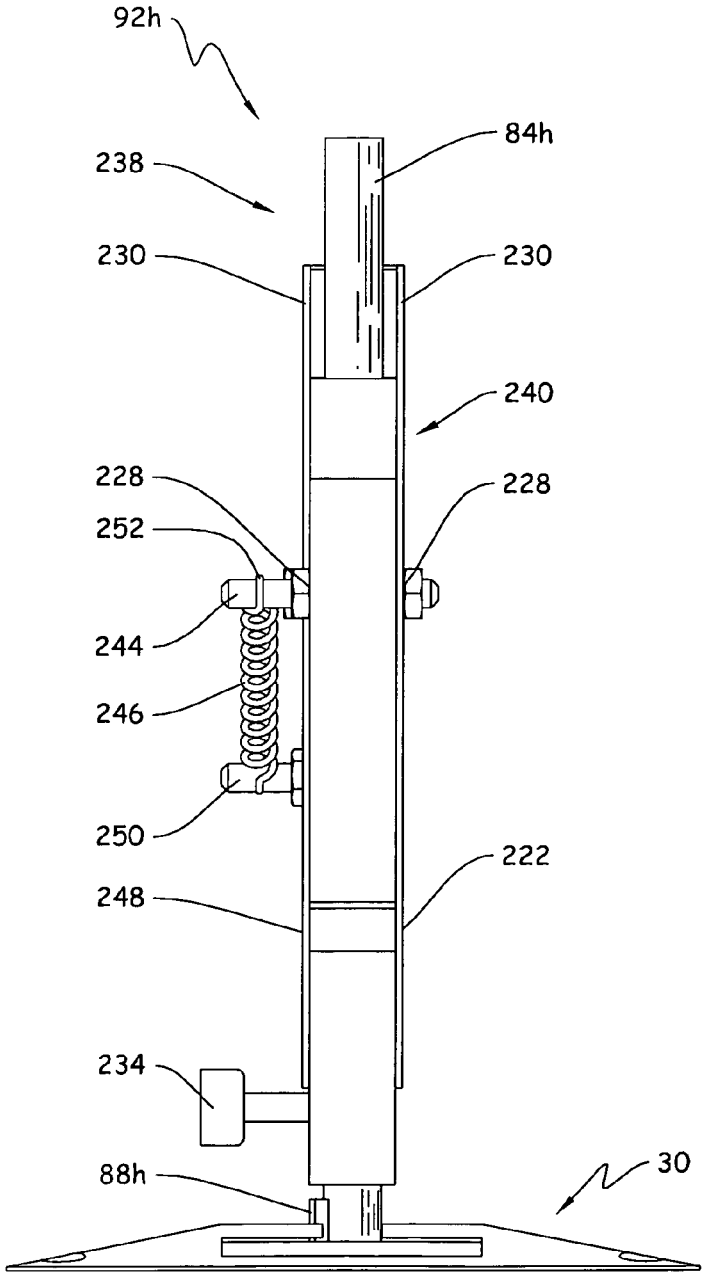
FIG. 41 illustrates a front plan view of the garbage can retaining device shown in FIGS. 33-40.
Figure 42:
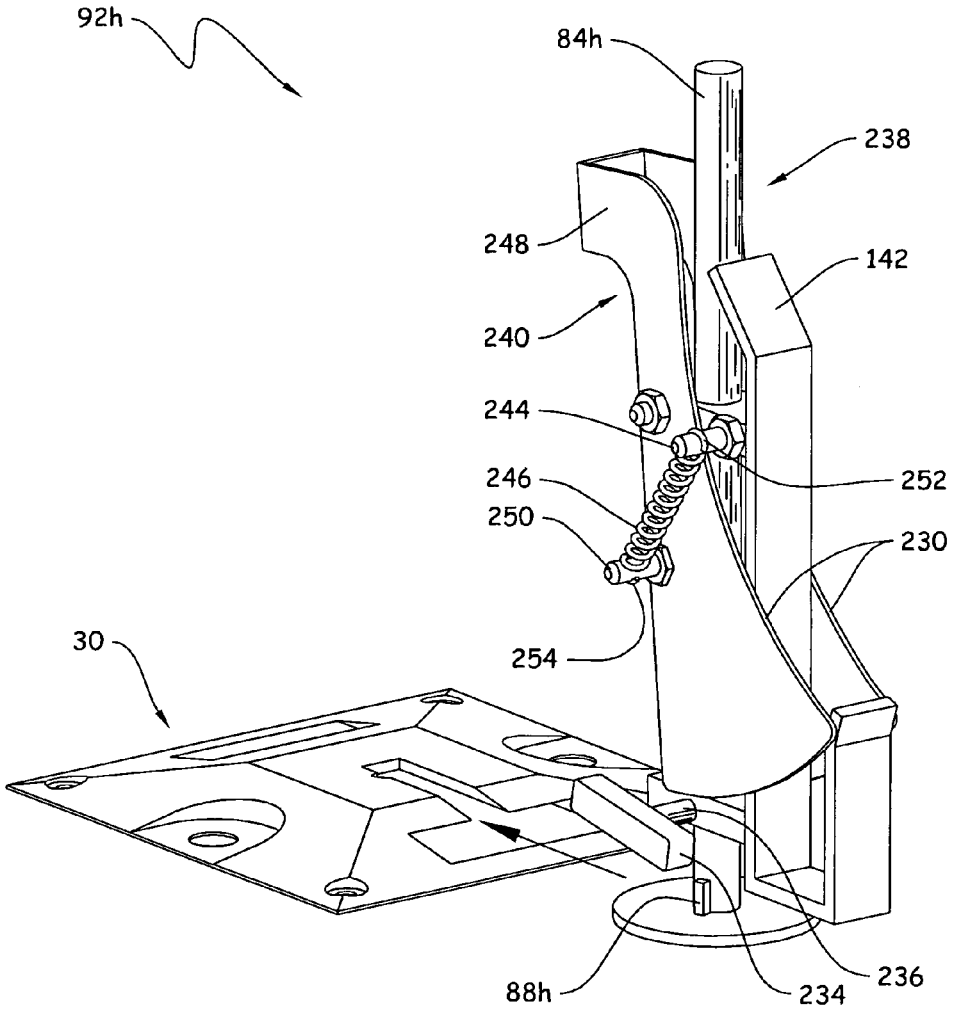
FIG. 42 illustrates a perspective view of a shaft and garbage can mounting portion including a pivot assembly including a counterweight adapted to slidably mount within a mounting member in accordance with an embodiment of the invention.

In an embodiment of the invention, the hook member 142 has a u-shaped lip hook 148 and an elongated portion 150 that is integrally formed with the shaft 84*h* via an upper hook member mounting plate 242 and a lower hook member mounting plate 216 (shown in FIGS. 33-35). The upper hook member mounting plate includes a tension spring mount 244 extending perpendicular to the upper hook member mounting plate 242. When the garbage can mounting portion 238 is mounted within the mount member 30 such that the shaft 84*h* is in a vertical position perpendicular to a ground surface, the elongated portion 150 of the hook member 142 extends upwardly from the u-shaped lip hook 148 towards the upper hook member mounting plate 242 and the lower hook member mounting plate 216. The hook member 142 may be permanently secured to the upper hook member mounting plate 242 and lower hook member mounting plate 216 by any suitable attachments means such as, but not limited to welding.

Referring now in particular to FIGS. 33-42, the pivot assembly 240 has a pivot 218 and a tension spring 246 mounted between a first and a second tension spring mount. In an embodiment of the invention, the pivot 218 has two opposing planar walls 222, 248 having wedge-shaped contours separated by a distance approximately equal to the width of the hook member 142 and an adjacent planar wall 226 attached to the opposing planar walls 222, 248 and separating the opposing planar walls 222, 248 the approximate distance of the hook member 142. Each wedge-shaped opposing planar wall 222, 248 defining a respective narrow tapered portion having a pivot hole 228 disposed therethrough for receiving a pivot bar 174 and a respective opposing flared portion adapted to contact an outer surface of a garbage can at a peripheral edge 230 of the opposing planar walls 222, 248 of the pivot 218 when an inverted garbage can lip is placed within the garbage can lip hook 148. The planar wall 248 includes a second tension spring mount 250 extending perpendicularly to the planar wall 248 and parallel to the first tension spring mount 244 associated with the upper hook member mounting plate 242.

The pivot assembly 240 includes a pivot bar hole 232 disposed through the upper hook member mounting plate 242, and a pivot bar 174 having two opposing ends and two pivot bar retainers 182, 184 adapted to mate with a respective pivot bar end. The pivot bar hole 232 disposed through the upper hook member mounting plate 242 is disposed to receive the pivot bar 174 therethrough, wherein the pivot bar is removably secured to the upper hook member mounting plate 242 when the pivot assembly 240 is assembled together, and the pivot bar 174 is initially disposed through the pivot bar hole 232. Then, each of the two pivot bar retainers 182, 184 respectively engage a one of the two opposing ends to prevent movement of the pivot bar 174 within the upper hook member mounting plate 242.

The biasing mechanism includes the tension spring 242 which includes a first looped end 252 and a second looped end 254. The first tension spring having a first looped end is looped around a first tension spring mount mounted on the upper hook member mounting plate; and a second looped end looped around a tension spring mount in a respective one of the opposing planar walls of the pivot assembly, wherein the spring is biased in a tension position when the pivot is oriented in a resting first position and wherein the spring is unbiased when the pivot is urged towards a second position. The first looped end 252 of the tension spring 242 is looped around the first tension spring mount 244 of the upper hook member mounting plate 242. The second looped end 254 of the tension spring 242 is looped around the secibd tension spring mount 250 of the opposing planar wall 248 of the pivot assembly 240. Restricting pressure within the tension spring 242 maintains the pivot assembly 240 in a biased position. The tension spring 242 may be made from an elastic material such as, but not limited to metal.

The hook member 142 cooperates with the pivot assembly 240 to removably retain a lip of a garbage can therein. The pivot assembly 240 is biased by restricting pressure in the tension spring 242. The pivot assembly 240 is biased to apply pressure to an edge of the pivot 230 against an outer surface of a garbage can when a lip of a top portion of an inverted and empty garbage can is held in position by the u-shaped garbage can lip hook. To unbias the pivot assembly and thereby remove the pressure of the pivot against the garbage can outer surface, pressure is applied to a head on an upper portion of the pivot assembly 240 thereby overcoming the restricting pressure in the tension spring 242. Once the pressure is relieved, the garbage can is lifted with an upward lifting movement. The garbage can may then be easily removed from the device by an upward lifting movement to disengage the lip from the garbage can lip hook 148.

The garbage can contacting portion 238 is vertically adjustable along the shaft 84*h* by means of a set screw 234. A set screw hole 236 is disposed through the lower hook member mounting plate 216. The set screw 234 is disposed within the set screw hole 236 such that the set screw 234 makes contact with the shaft 84*h* when the set screw 234 is rotated to an engaged position and ceases to make contact with the shaft 84*h* when rotated to a disengaged position. When the set screw 234 is rotated into the engaged position, the set screw 234 makes contact with the shaft 84*h* and the garbage can mounting portion 238 is firmly secured to the shaft 84*h*. When the set screw 234 is rotated to the disengaged position, the set screw 234 ceases to make contact with the shaft 84*h* and the can mounting portion 238 may be adjusted vertically along the shaft 84*h*. When the garbage can mounting portion 238 is adjusted, the set screw 234 may be rotated to the engaged position to firmly secure the garbage can mounting portion 238 to the shaft 84*h*.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the embodiments of the invention without departing from the spirit and scope of the appended claims.

What is claimed is:

1. A garbage can retaining device for retaining a garbage can includes:

a mount member adapted to mount the garbage can retaining device to any substantially planar surface, wherein the mount member is adapted to receive a shaft and base assembly within an interior region of the mount member and to fixedly secure the shaft and base assembly to the mount member, the shaft and base assembly including a shaft coextensive with a height of said device and having a plurality of attachments attached thereto, said shaft having a lower portion and an upper portion;

a garbage can contacting portion secured to the shaft, said garbage can contacting portion attached to or integral with said upper portion; and a base securely formed with the shaft adapted to be slidably received within the interior region of the mount member, wherein the mount member comprises a top cover portion including a top planar surface formed within the mount member in open communication with the interior region to receive the shaft including a locking tab slot having a complementary shape to a locking tab associated with the shaft and base assembly; and a bottom planar portion having a peripheral edge, wherein the bottom planar portion is adapted to mount to both natural earth and a manmade surface.

2. The garbage can retaining device of claim 1, wherein the top cover portion top planar surface comprises:

a top groove formed therein to slidably receive the shaft therethrough, wherein the locking tab slot angles outwardly from the top groove along the top planar surface, and wherein the mount member further includes angled portions extending downwardly from the top cover portion top planar portion to the peripheral edge of the bottom planar surface.

3. The garbage can retaining device of claim 1, wherein the shaft comprises:

the lower portion having a first end integrally formed with the base; and a locking tab integrally formed with both the lower portion of the shaft and with the base adapted to mate with the complementarily shaped locking tab slot formed within the top cover portion of the mount member.

4. The garbage can retaining device of claim 3, wherein the garbage can contacting portion comprises:

the upper portion of the shaft having a second end comprising a T-shaped flange adapted to receive a bottom interior portion of an upside-down empty garbage can, wherein the T-shaped flange prevents the shaft second end from puncturing a bottom of the garbage can;

a loop member integrally formed with the shaft near the second end of the shaft to receive a clasping member, wherein the clasping member secures a chain having a vice grip at the end of the chain adapted to securely removably engage a handle portion of a garbage can; and a garbage can retaining hook.

* * * * *

UNITED STATES PATENT AND TRADEMARK OFFICE

CERTIFICATE OF CORRECTION

PATENT NO. : 8,833,710 B1
APPLICATION NO. : 12/928846
DATED : September 16, 2014
INVENTOR(S) : Atkinson It is certified that error appears in the above-identified patent and that said Letters Patent is hereby corrected as shown below:

On the Title Page

Item (57) In the Abstract; Line 3; Please delete "including".

In the Specification

Column 2; Line 9; Please delete the first occurrence of "of the".

Column 2; Line 50; Please delete the first occurrence of "of the".

Column 2; Line 62; Please delete the first occurrence of "of the".

Column 3; Line 13; Please delete the first occurrence of "of the".

Column 3; Line 25; Please delete the first occurrence of "of the".

Column 6; Line 12; Please delete "of the".

Column 7; Line 36; Please delete the first occurrence of "of the".

Column 12; Line 17; Please delete "a".

Column 12; Line 33; Please delete "secibd" and insert --second--.

Signed and Sealed this
Twenty-third Day of December, 2014

Michelle K. Lee

Michelle K. Lee
*Deputy Director of the United States Patent and Trademark Office*